US007734237B2

(12) United States Patent
Mukai

(10) Patent No.: US 7,734,237 B2
(45) Date of Patent: Jun. 8, 2010

(54) IMAGE FORMING APPARATUS WITH FIXING FLUID APPLICATION DEVICE

(75) Inventor: Takashi Mukai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 287 days.

(21) Appl. No.: 11/798,106

(22) Filed: May 10, 2007

(65) Prior Publication Data

US 2007/0264058 A1 Nov. 15, 2007

(30) Foreign Application Priority Data

May 11, 2006 (JP) ..... 2006-133112

(51) Int. Cl.
*G03G 15/16* (2006.01)
*G03G 15/20* (2006.01)

(52) U.S. Cl. ..... 399/307; 399/325

(58) Field of Classification Search ..... 399/307, 399/324, 325

See application file for complete search history.

(56) References Cited

U.S. PATENT DOCUMENTS 5,351,114 A * 9/1994 Matsuno ..... 399/307
2002/0146258 A1* 10/2002 Iida et al. ..... 399/307
2006/0133863 A1* 6/2006 Asakura et al. ..... 399/307

FOREIGN PATENT DOCUMENTS

JP 2004-109751 4/2004
JP 2004-294847 10/2004
JP 2004-333866 11/2004

OTHER PUBLICATIONS

Computer Translation of JP2004-294847A Computer Translation of JP2004-333866A.*
Computer translation of applicant cited reference JP2004-333866A.*

* cited by examiner

*Primary Examiner*—Quana M Grainger
(74) *Attorney, Agent, or Firm*—Nixon & Vanderhye, PC

(57) ABSTRACT

An image forming apparatus of the wet fixing method includes a toner image forming section, a intermediate transfer section including an intermediate transfer belt, a fixing fluid applying section that applies a fixing fluid to a toner image on the intermediate transfer belt and swells and/or softens the toner image, a transferring and fixing section, a recording medium feeding section, and a scanner section. The fixing fluid applying section and the transferring and fixing section are placed so that, when the toner image in a swelled and/or softened state on the intermediate transfer belt is transferred and fixed to a recording medium, adhesive force A between toner forming the toner image and the intermediate transfer belt becomes smaller than adhesive force B between the toner and the recording medium.

9 Claims, 19 Drawing Sheets

IMAGE FORMING APPARATUS WITH FIXING FLUID APPLICATION DEVICE

CROSS-REFERENCE TO RELATED APPLICATION

This application claims priority to Japanese Patent Application No. 2006-133112, which was filed on May 11, 2006, the contents of which, are incorporated herein by reference, in their entirety.

BACKGROUND OF THE TECHNOLOGY

1. Field of the Technology

The present technology relates to an image forming apparatus.

2. Description of the Related Art

The adoption of electrophotographic image forming apparatuses as copying machines, printers, facsimile machines, and the like equipment has been widespread. In general, image formation is carried out by an electrophotographic image forming apparatus as follows. As a photoreceptor, there is used a photoreceptor on which surface a photosensitive layer containing a photoconductive substance is formed. After electric charge is applied to the surface of the photoreceptor in such a way that the entire surface is charged evenly, an electrostatic latent image corresponding to specific image data is formed thereon through various process steps for image formation. The electrostatic latent image is developed into a toner image by using a developer containing toner that has been supplied from a developing section. The toner image is directly transferred onto a recording medium such as a paper sheet, or is transferred onto an intermediate transfer medium once and is thereafter transferred onto a recording medium. Lastly, the toner image transferred onto the recording medium is fixed into place. The fixation of the toner image onto the recording medium can usually be achieved by heating and pressing the recording medium with use of a fixing section constructed based on a heat fixing method, for example, a fixing roller comprising a heating section.

However, there has been a growing trend recently to achieve energy conservation as a countermeasure against global warming. As a natural consequence thereof, a reduction in power consumption required to fix a toner image onto a recording medium has come to be increasingly demanded of an electrophotographic image forming apparatus. Unfortunately, the heat fixing method presents the following disadvantages. Firstly, a heating section is used inside the image forming apparatus, wherefore the apparatus is interiorly heated to a high temperature. This creates the need to enhance the heat resistance of constituent components, which results in an undesirable increase in material costs. Secondly, image fixation cannot be effected until a part to be fixed has been heated to a predetermined temperature. In this case, the time required for the to-be-fixed part to reach the predetermined temperature, namely, warm-up time, tends to be increased. Thirdly, much time needs to be spent in fixing a multi-color toner image onto a recording medium as compared to the case of fixing a monochromatic toner image. Accordingly, a reduction in time required to fix a multi-color toner image has been sought after.

In view of the foregoing requirements, a wet fixing method has been known that employs a fixing fluid containing water and a liquid which is dissoluble or dispersible in water and produces the effect of softening or swelling out toner. According to the wet fixing method, a toner image is brought into a softened or swollen state through the application of the fixing fluid. In this state, the toner image is adhered to a recording medium, and is then fixed into place by pressurization. The wet fixing method consumes far less power than does the heat fixing method, and is thus of a useful method from energy-saving standpoint. Another advantage is that the wet fixing method does not require a large amount of heat to fix a multi-color toner image. This, in contrast to the case of adopting the heat fixing method, enables a reduction in fixation time. Accordingly, various proposals have been made for further improvements of the wet fixing method.

For example, there is a proposal of an image forming apparatus that, when applying a fixing fluid to a toner image transferred onto a recording medium and fixing the toner image to the recording medium, heats or pressurizes the toner image before applying the fixing fluid, thereby increasing toner-to-toner binding force of toner forming the toner image (refer to Japanese Unexamined Patent Publication JP-A 2004-294847, for example). According to the image forming apparatus of JP-A 2004-294847, since the toner forming the toner image is softened to some extent by heating or pressing before application of the fixing fluid, it is possible to reduce the amount of the used fixing fluid. On the other hand, however, in a case where recording paper, which is the most generally used as a recording medium, is used, the recording paper absorbs the fixing fluid in large amounts. Therefore, substantial reduction of the amount of the consumed fixing fluid is not realized as a whole. Accordingly, the following method has been proposed in a lot of documents. That is, the method comprises steps of: applying a fixing fluid to a toner image on an intermediate transfer belt hardly absorbing the fixing fluid; softening and/or swelling toner forming the toner image on the intermediate transfer belt; making the intermediate transfer belt and a recording medium in contact with each other in a transferring and fixing section; and transferring and fixing the toner image on the intermediate transfer belt to the recording medium by adhesive force of the softened and/or swelled toner. According to this method, since the intermediate transfer belt does not absorb the fixing fluid, it is possible to substantially reduce the amount of the consumed fixing fluid, whereas a problem resulting from use of the intermediate transfer belt newly arises. In this method, the intermediate transfer belt and the recording medium are made in contact with each other in the transferring and fixing section, the toner image on the intermediate transfer belt is transferred and fixed to the recording medium, and thereafter, the recording medium is peeled from the intermediate transfer belt. However, depending on timing of peeling the recording medium from the intermediate transfer belt, the toner image may be transferred to the recording medium insufficiently, thereby remaining on the intermediate transfer belt. In this case, image defect is caused in a formed image.

According to research by the inventor, what determines whether a toner image is transferred to a recording medium or remains on the intermediate transfer belt is presumed to be, mainly, the amount of the applied fixing fluid, and fluctuations of adhesive force between the intermediate transfer belt and swelled and/or softened toner (referred to as the "adhesive force A" hereafter) and adhesive force between the recording medium and the swelled and/or softened toner (referred to as the "adhesive force B" hereafter) during a required time from when the fixing fluid is applied to the toner image on the intermediate transfer belt to when the recording medium is peeled from the intermediate transfer belt.

FIGS. 20 to 22 are graphs each illustrating a relation between a time after application of the fixing fluid to the toner image and the adhesive force (the adhesive force A and the adhesive force B). In the drawings, the time after application of the fixing fluid to the toner image is plotted on the horizontal axis, and is referred to as the "time after application." The adhesive force is plotted on the vertical axis. The adhesive force A is shown by a solid line, and the adhesive force B is shown by a dashed line. The adhesive force is a value measured by a measurement method described later. FIG. 20 is a graph illustrating a relation between the time after application and the adhesive force in a case where the amount of the applied fixing fluid is more than an amount to sufficiently swell and/or soften the toner image. Since the intermediate transfer belt retains heat or static electricity transmitted when coming in contact with other components, the adhesive force A is somewhat high already at a point that application of the fixing fluid starts. When application of the fixing fluid starts in this state, the adhesive force A gradually increases from a value at the point that application starts because the toner forming the toner image is swelled and/or softened. After that, because the fixing fluid is dried up, and releasability of the surface of the intermediate transfer belt appears, the adhesive force A gradually decreases, and becomes constant. Although the adhesive force B is considerably smaller than the adhesive force A at the point that application of the fixing fluid starts, the adhesive force B increases more rapidly than the adhesive force A when application of the fixing fluid starts. The maximum value is determined based on surface roughness of the recording medium, permeability to the recording medium, and so on, and the adhesive force B becomes constant. In a case where the amount of the applied fixing fluid is large, the maximum value of the adhesive force A is larger than the maximum value of the adhesive force B.

FIG. 21 is a graph illustrating a relation between the time after application and the adhesive force in a case where the amount of the applied fixing fluid is an amount that is not too much nor too little to swell and/or soften the toner image (a proper amount). In this case, since the amount of the applied fixing fluid is proper, the fixing fluid hardly penetrates through an interface between the intermediate transfer belt and the toner image. Therefore, the adhesive force A keeps an initial value resulting from the heat or static electricity retained by the intermediate transfer belt regardless of a lapse of time, and the value is constant. Although the adhesive force B rapidly increases right after application of the fixing fluid because the fixing fluid penetrates through the toner as in the case of FIG. 20, the adhesive force B becomes constant when reaching the maximum value. In a case where the amount of the applied fixing fluid is proper, the maximum value of the adhesive force A is smaller than the maximum value of the adhesive force B. FIG. 22 is a graph illustrating a relation between the time after application and the adhesive force in a case where the amount of the applied fixing fluid is less than the amount to sufficiently swell and/or soften the toner image. In this case, since the amount of the applied fixing fluid is small, the fixing fluid hardly penetrates through the interface between the intermediate transfer belt and the toner image as in the case of FIG. 21. Therefore, the adhesive force A keeps the initial value resulting from the heat or static electricity retained by the intermediate transfer belt regardless of a lapse of time, and the value is constant. The adhesive force B rapidly increases right after application of the fixing fluid because the fixing fluid penetrates through the toner. However, since the amount of the applied fixing fluid is small, the adhesive force B rapidly increases temporarily, and becomes constant at a value lower than the adhesive force A.

For the relations as described above, in order to peel the recording medium from the intermediate transfer belt in a state where the toner image is transferred to the recording medium in the almost complete form, it is necessary to select a period of time in which the adhesive force B is higher in value than the adhesive force A in the time after application. Consequently, it is possible to obtain a high-quality image without image defect. On the other hand, in toner images formed by a color image forming apparatus, monochrome toner images and laminated toner images formed by laminating toner images of two different colors or more are mixed. When a proper amount of fixing fluid to swell and/or soften the monochrome toner image is applied to the laminated toner image, the amount of the applied fixing fluid becomes insufficient, and the adhesive force B becomes lower than the adhesive force A at all times as illustrated in FIG. 22. Therefore, there is a high possibility that the toner image remains on the intermediate transfer belt. On the contrary, when a proper amount of fixing fluid to swell and/or soften the multicolor toner image is applied to the monochrome toner image, the amount of the applied fixing fluid becomes excessive, and it is necessary to design so as to peel between time t1 and time t2 or after time t3 as illustrated in FIG. 20. Therefore, such an image forming apparatus is desired that the adhesive force B is higher in value than the adhesive force A at all times and a recording medium can be peeled from the intermediate transfer belt in a state where a toner image is almost completely transferred onto the recording medium.

SUMMARY OF THE TECHNOLOGY

An object of the technology is to provide an image forming apparatus using a fixing fluid for fixing a toner image on a recording medium, in which apparatus residue of toner on a toner image bearing member may cause image defects is prevented.

The technology provides an image forming apparatus comprising:

a toner image forming section that forms a toner image;

a toner image bearing section including a toner image bearing member that rotates while bearing on a surface thereof the toner image formed by the toner image forming section;

a transfer section that transfers the toner image on the toner image bearing member onto a recording medium; and a fixing fluid applying section that applies a fixing fluid having an effect of softening toner, to the toner image on the toner image bearing member, wherein the fixing fluid applying section and the transfer section are placed so that adhesive force A (N/25 mm) between the toner and the toner image bearing member becomes smaller than adhesive force B (N/25 mm) between the toner and the recording medium when the toner image with the fixing fluid is transferred from the toner image bearing member to the recording medium.

The image forming apparatus comprises: the toner image forming section; the toner image bearing section including the toner image bearing member that rotates while bearing on a surface thereof the toner image; the transfer section that transfers the toner image on the toner image bearing member onto the recording medium; and the fixing fluid applying section that applies the fixing fluid to the toner image on the toner image bearing member. In the image forming apparatus, the fixing fluid applying section and the transfer section are placed so that the adhesive force A (N/25 mm) between the toner and the toner image bearing section becomes smaller than the adhesive force B (N/25 mm) between the toner and the recording medium when the toner image swelled and/or softened by application of the fixing fluid on the toner image bearing member is transferred and fixed to the recording medium. Consequently, when the recording medium is peeled from the toner image bearing member, the toner image does not remain on the toner image bearing member, and the toner image can be almost completely transferred to the recording medium. Therefore, according to the image forming apparatus, it is possible to stably form a high-quality image without image defect caused by the toner image remaining on the toner image bearing member. Moreover, in the image forming apparatus, the toner image is fixed to the recording medium by the wet fixing method using the fixing fluid, with the result that consumption of electric power can be largely reduced as compared to that in the image forming apparatus mainly using the heat fixing method.

Further, it is preferable that the image forming apparatus further comprises:

a moving section that supports the fixing fluid applying section so as to be movable along the toner image bearing member; and a movement control section that controls a position of the fixing fluid applying section moved by the moving section.

The image forming apparatus further comprises the moving section that supports the fixing fluid applying section so as to be movable along the toner image bearing member, and the movement control section that controls the position of the fixing fluid applying section moved by the moving section, thereby easily obtaining the positional relation between the fixing fluid applying section and the transfer section for realizing the condition of adhesive force B>adhesive force A when transferring and fixing the toner image to the recording medium.

Furthermore, it is preferable that the image forming apparatus further comprises a heating section that heats the toner image on the toner image bearing member, and/or a pressing section that presses the toner image on the toner image bearing member, provided on an upstream side of the transfer section in a rotation direction of the toner image bearing member.

The image forming apparatus further comprises the heating section that heats the toner image on the toner image bearing member, and/or the pressing section that presses the toner image on the toner image bearing member, provided on the upstream side of the transfer section in the rotation direction of the toner image bearing member. Consequently, only a surface of the toner image on the toner image bearing member, namely, only a face fixed to a recording medium is made into a film by heat or pressure, thereby exhibiting high adhesiveness. On the other hand, since the toner image is not made into a film at an interface between the toner image bearing member and the toner image, the adhesive force A does not increase. When the surface of the toner image made into a film comes in contact with the recording medium, the adhesive force B is higher than when the surface is not made into a film. Therefore, the toner image is securely transferred and fixed to the recording medium while the part made into a film keeps the shape of a film.

Still further, it is preferable that the toner image bearing member is an endless belt-shaped member having a fluororesin containing layer on a surface thereof.

Since a surface layer of the toner image bearing member, namely, a toner image bearing face contains fluororesin, it is possible to further decrease the adhesive force A, and further securely transfer and fix the toner image to the recording medium.

Still further, it is preferable that the toner image bearing member is an endless belt-shaped member including an elastic layer.

Since the toner image bearing member includes the elastic layer, the contact area of the toner image and the recording medium increases and the adhesive force B increases when the toner image is transferred to the recording medium. Therefore, the toner image is further securely transferred and fixed to the recording medium.

Still further, it is preferable that the image forming apparatus further comprises a fixing fluid application amount control section that controls an amount of the fixing fluid applied to the toner image by the fixing fluid applying section.

The image forming apparatus of the invention further comprises the fixing fluid application amount control section that controls the amount of the fixing fluid applied to the toner image by the fixing fluid applying section, thereby more easily obtaining the relation of adhesive force B>adhesive force A when transferring and fixing the toner image in a swelled and/or softened state to the recording medium.

BRIEF DESCRIPTION OF THE DRAWINGS

Other and further objects, features, and advantages will be more explicit from the following detailed description taken with reference to the drawings wherein.

DETAILED DESCRIPTION

Figure 1:
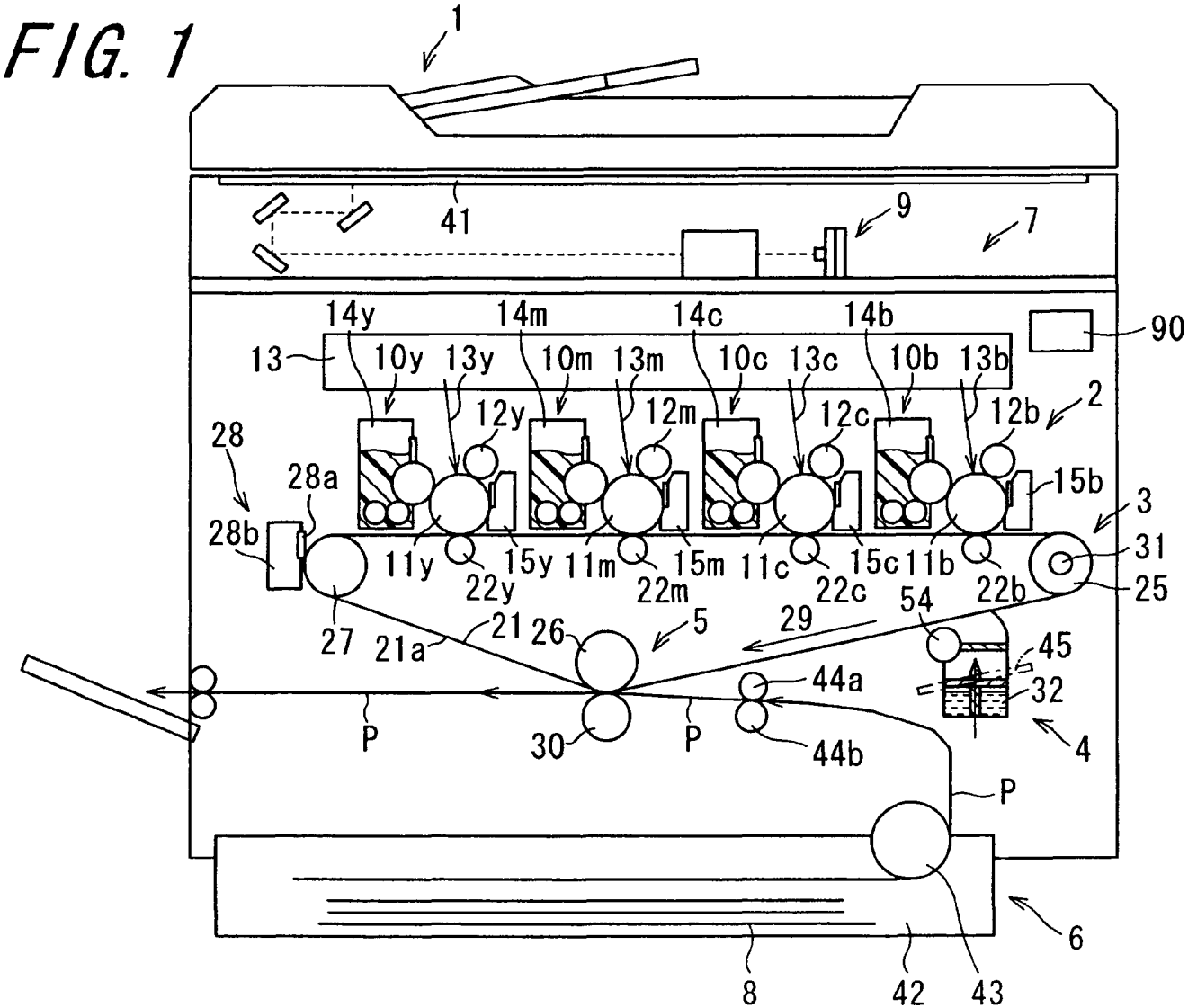
FIG. 1 is a sectional view schematically showing the constitution of an image forming apparatus according to a first embodiment.

Now referring to the drawings, preferred embodiments are described below.

Figure 2:
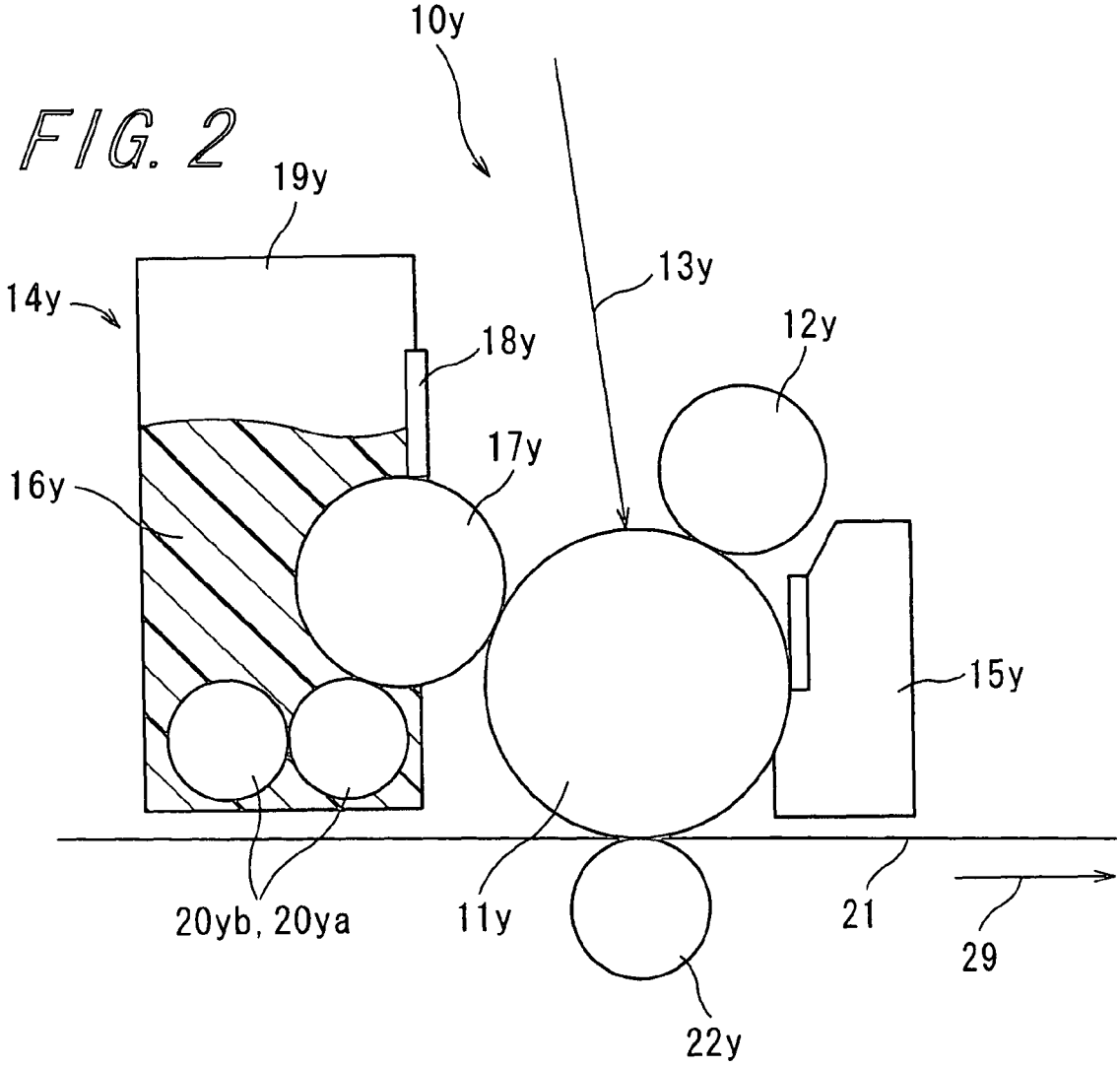
FIG. 2 is an enlarged sectional view showing the structure of principal portion of the image forming apparatus depicted in FIG. 1.
Figure 3:
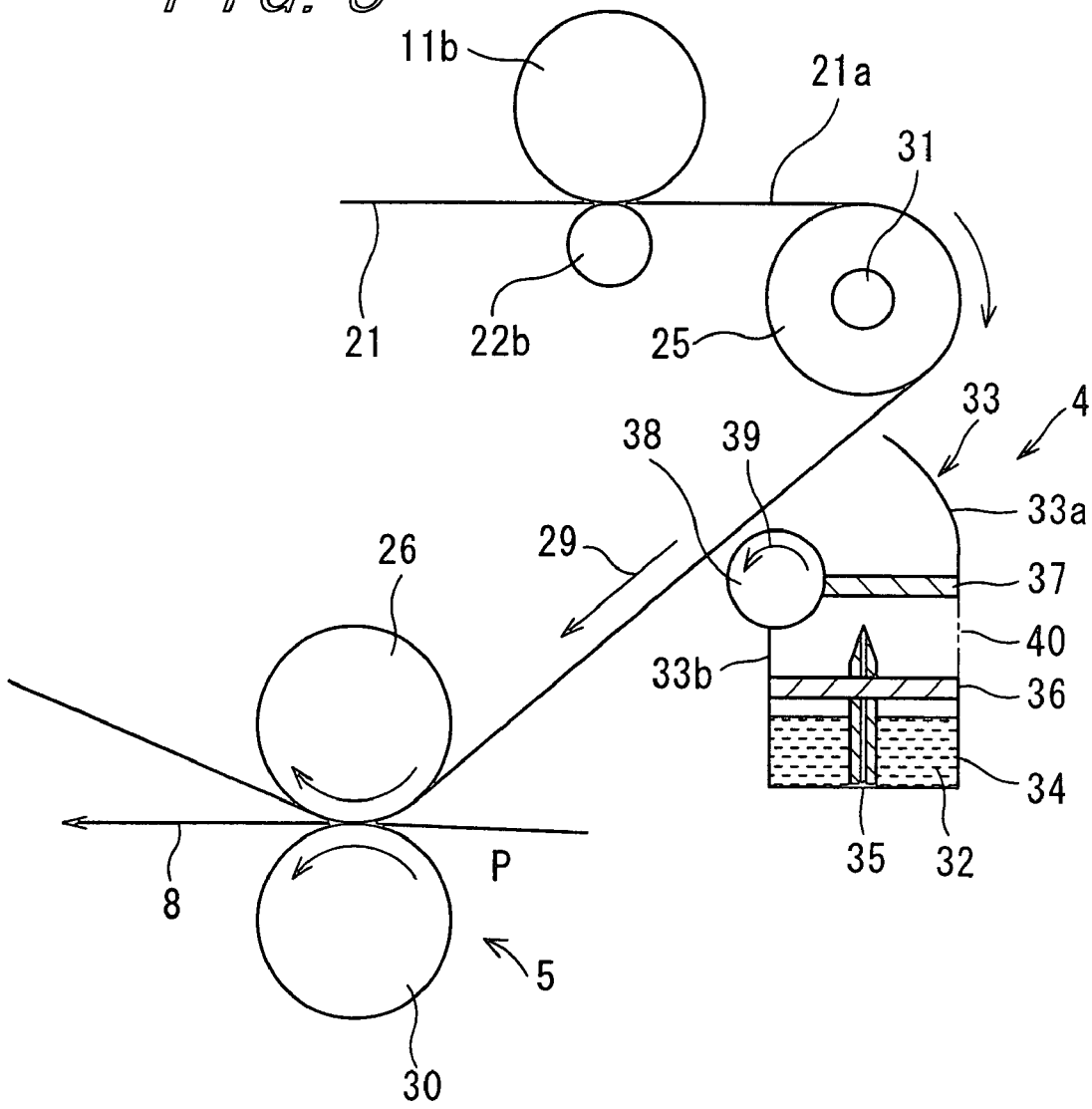
FIG. 3 is an enlarged sectional view showing the structure of principal portion of the image forming apparatus depicted in FIG. 1.
Figure 4:
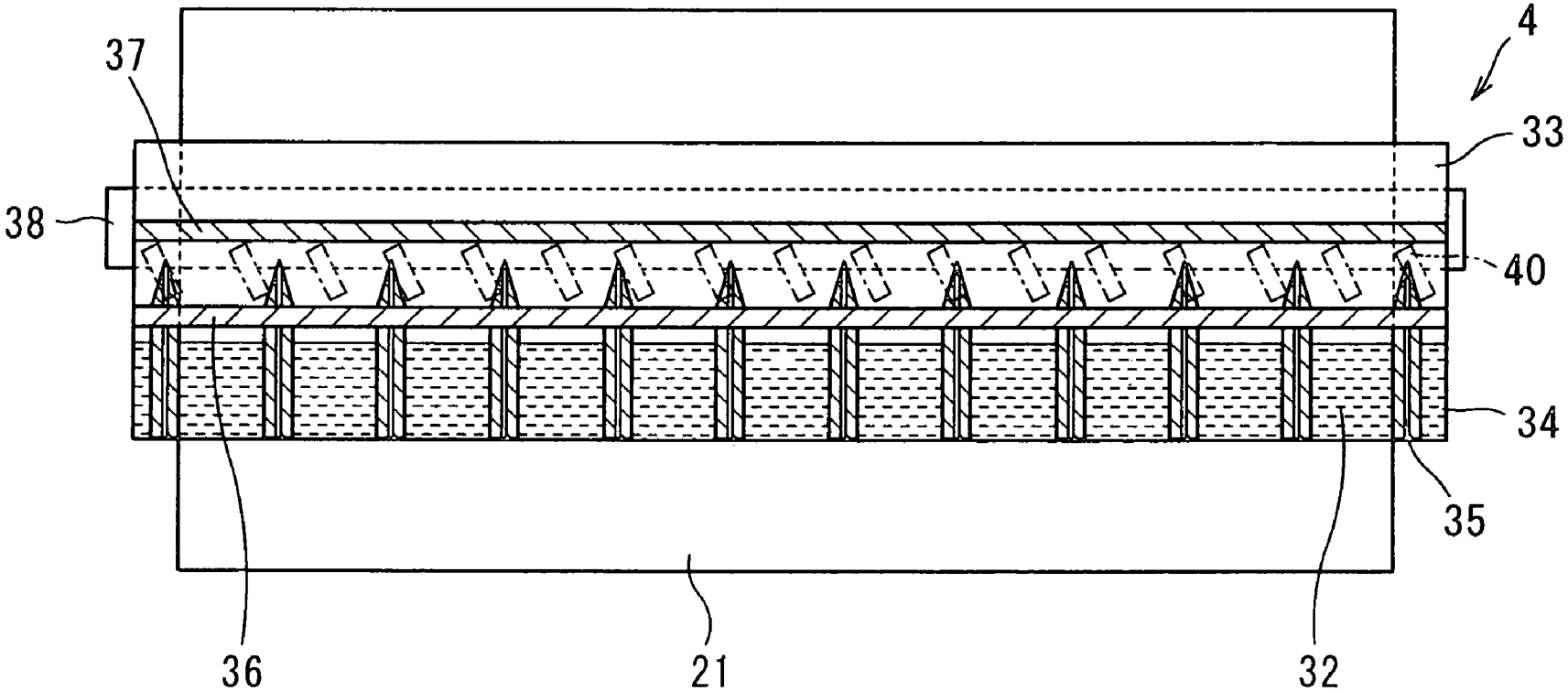
FIG. 4 is a longitudinal sectional view schematically showing the configuration of a fixing fluid applying section.

FIG. 1 is a sectional view schematically showing the constitution of an image forming apparatus 1 according to a first embodiment. FIG. 2 is an enlarged sectional view showing the structure of principal portion (a toner image forming section 2 described later) of the image forming apparatus 1 depicted in FIG. 1. FIG. 3 is an enlarged sectional view showing the structure of principle portion (a fixing fluid applying section 4 described later) of the image forming apparatus 1 depicted in FIG. 1. FIG. 4 is a longitudinal sectional view schematically showing the configuration of the fixing fluid applying section 4. The image forming apparatus 1 is built as a tandem-system electrophotographic image forming apparatus in which toner images of four colors: yellow; magenta; cyan; and black are transferred one after another and overlaid. The image forming apparatus 1 is composed of the toner image forming section 2, an intermediate transfer section 3, the fixing fluid applying section 4, a transferring and fixing section 5, a recording medium feeding section 6, and a scanner section 7.

The toner image forming section 2 includes an image forming unit 10*y*, an image forming unit 10*m*, an image forming unit 10*c*, and an image forming unit 10*b*. The image forming units 10*y*, 10*m*, 10*c* and 10*b* are aligned in a row in this order from the upstream side in a rotation direction of an intermediate transfer belt 21 described later (a sub scanning direction), that is, in a direction of arrow 29. In the image forming units 10*y*, 10*m*, 10*c*, and 10*b* are formed electrostatic latent images corresponding to image data of predetermined different colors inputted in the form of digital signals and the like, and the resultant electrostatic latent images are individually developed into toner images of the predetermined different colors. In other words, the image forming unit 10*y* is responsible for formation of a toner image corresponding to yellow-color image data; the image forming unit 10*m* is responsible for formation of a toner image corresponding to magenta-color image data; the image forming unit 10*c* is responsible for formation of a toner image corresponding to cyan-color image data; and the image forming unit 10*b* is responsible for formation of a toner image corresponding to black-color image data. The image forming unit 10*y* includes a photoreceptor drum 11*y*, a charging roller 12*y*, a light scanning unit 13*y*, a developing device 14*y*, and a drum cleaner 15*y*.

The photoreceptor drum 11*y* is a roller-shaped member that is supported so as to be capable of being rotated around an axis thereof by a driving mechanism (not illustrated) and that has, on a surface thereof, a photosensitive layer on which an electrostatic latent image and furthermore a toner image is formed. The photoreceptor drum 11*y* is, for example, a photoreceptor drum including a conductive substrate and a photosensitive layer formed on the surface of the conductive substrate. As the conductive substrate, it is possible to use conductive substrates having a cylindrical shape, a columnar shape, a sheet-like shape and the like. In particular, a conductive substrate having a cylindrical shape is preferable. The photosensitive layer is an organic photosensitive layer, an inorganic photosensitive layer, and the like. The organic photosensitive layer is, for example, a lamination composed of a charge generation layer that is a resin layer containing a charge generation substance and a charge transport layer that is a resin layer containing a charge transport substance, and a resin layer containing a charge generation substance and a charge transport substance in one resin layer. The inorganic photosensitive layer is a layer containing one kind or two kinds or more selected from among zinc oxide, selenium, amorphous silicon and so on. A blocking layer may be interposed between the conductive substrate and the photosensitive layer, and a surface layer (a protecting layer) for mainly protecting the photosensitive layer may be formed on the surface of the photosensitive layer. In the present embodiment, such a photoreceptor drum is used that has a diameter of 30 mm and includes an aluminum cylinder (the conductive substrate) connected to a ground (GND) and an organic photosensitive layer having a thickness of 20 μm formed on the surface of the aluminum cylinder. In the present embodiment, the photoreceptor drum 11*y* rotates in a clockwise direction at a circumferential velocity of 117 mm/s.

The charging roller 12*y* is a roller-shaped member that is rotatably supported around an axis thereof by a driving mechanism (not illustrated) and that charges the surface of the photoreceptor drum 11*y* with a predetermined polarity and at a predetermined potential. A power supply (not illustrated) is connected to the charging roller 12*y* and applies voltage thereto, and the charging roller discharges electricity and thereby charges the surface of the photoreceptor drum 11*y*. In the present embodiment, a voltage of −1200V is applied to the charging roller 12*y*, and the surface of the photoreceptor drum 11*y* is charged at −600V. Instead of the charging roller 12*y*, it is possible to use a brush-type charging device, a charger-type charging device, a corona charging device such as a scorotron charger, and the like. The light scanning unit 13 applies laser light 13*y* corresponding to the yellow-color image data to the surface of the photoreceptor drum 11*y* in a charged state, and forms an electrostatic latent image corresponding to the yellow-color image data on the surface of the photoreceptor drum 11*y*. It is possible to use a semiconductor laser and the like for the light scanning unit 13. In the present embodiment, an electrostatic latent image having an exposure potential of −70V is formed on the surface of the −600 V-charged surface of the photoreceptor drum 11*y*.

The developing device 14*y* includes a developing roller 17*y*, a developing blade 18*y*, a developer reservoir 19*y*, and agitating rollers 20*ya* and 20*yb*. The developing roller 17*y* bears yellow toner 16*y* on a surface thereof, and supplies the yellow toner 16*y* to an electrostatic latent image formed on the surface of the photoreceptor drum 11*y*, at a pressure-contact area (a development nip area) between the developing roller 17*y* and the photoreceptor drum 11*y*. The developing roller 17*y* is a roller-shaped member that is supported by the developer reservoir 19*y*, that partly protrudes outward from an opening formed on a face of the developer reservoir 19*y* facing the photoreceptor drum 11*y*, that is brought into pressure-contact with the surface of the photoreceptor drum 11*y*, and that is rotatably disposed around an axis thereof. The developing roller 17*y* rotates in the reverse direction to the rotation direction of the photoreceptor drum 11*y*. Therefore, at the development nip area, the developing roller 17*y* and the photoreceptor drum 11*y* rotate in the same direction. A power supply (not illustrated) is connected to the developing roller 17*y* and applies DC voltage (a developing voltage) thereto. Consequently, the yellow toner 16*y* borne on the surface of the developing roller 17*y* is smoothly supplied to the electrostatic latent image. In the present embodiment, a developing voltage of −240V is applied to the developing roller 17*y*. The developing roller 17*y* rotates at a circumferential velocity of 175.5 mm/s which is 1.5 times faster than that of the circumferential velocity of the photoreceptor drum 11*y*. A layer of the yellow toner on the surface of the developing roller 17*y* comes in contact with the photoreceptor drum 11*y* at the development nip area, and the yellow toner 16*y* is supplied to the electrostatic latent image.

The developing blade 18*y* is a plate-shaped member disposed so that one end is supported by the developer reservoir 19*y* and the other end is brought into pressure-contact with the surface of the developing roller 17*y*. The developing blade acts to provide uniformity in the yellow toner layer borne on the surface of the developing roller 17*y* (layer regulation). The developer reservoir 19*y* is a container-shaped member having the opening on the face facing the photoreceptor drum 11*y* as described above and having an internal space. The developer reservoir 19*y* contains the developing roller 17*y* and the agitating rollers 20*ya* and 20*yb* in the internal space, and stores the yellow toner 16*y*. The developer reservoir 19*y* is replenished with the yellow toner 16*y* from a toner cartridge (not illustrated) according to the consumption condition of the yellow toner 16*y*. Although a single-component developer containing only the yellow toner 16*y* is used in the present embodiment, a developer is not limited to the single-component one, and it is also possible to use a two-component developer in which the yellow toner 16*y* and magnetic carriers are mixed.

The agitating rollers 20*ya* and 20*yb* are screw-shaped members which are brought into pressure-contact with each other in the internal space of the developer reservoir 19*y* and rotatably supported around axes. The agitating roller 20*ya* is disposed in pressure-contact with the surface of the developing roller 17*y*. The agitating rollers 20*ya* and 20*yb* respectively rotate to thereby send and supply the yellow toner 16*y* supplied into the developer reservoir 19*y* from the toner cartridge (not illustrated), to an area around the surface of the developing roller 17*y*. In the present embodiment, each of the photoreceptor drum 11*y*, the developing roller 17*y*, the developing blade 18*y* and the agitating rollers 20*ya* and 20*yb* is disposed so as to properly abut against any of the components. However, instead of thus disposing, it is also possible to dispose each of the components so as to be spaced and isolated from the other component in an area corresponding to an area to abut against the other component.

The drum cleaner 15*y* removes and collects the yellow toner 16*y* remaining on the surface of the photoreceptor drum 11*y* after transfer of a yellow toner image on the surface of the photoreceptor drum 11*y* to the intermediate transfer belt 21 as described later. According to the image forming unit 10*y*, onto the surface of the photoreceptor drum 11*y* charged by the charging roller 12*y*, the light scanning unit 13 applies the signal beam 13*y* corresponding to the yellow image data to form an electrostatic latent image, and the developing device 14*y* supplies the yellow toner 16*y* to the electrostatic latent image to develop the electrostatic latent image, whereby the yellow toner image is formed. As described later, the yellow toner image is transferred to the intermediate transfer belt 21 that rotates in the direction of arrow 29 in pressure-contact with the surface of the photoreceptor drum 11*y*. The yellow toner 16*y* remaining on the surface of the photoreceptor drum 11*y* is removed and collected by the drum cleaner 15*y*. The operation for forming an image (a toner image) as described above is repeatedly executed. The image forming units 10*m*, 10*c* and 10*b* have components equivalent to those of the image forming unit 10*y*, except that magenta toner 16*m*, cyan toner 16*c* and black toner 16*b* are used instead of the yellow toner 16*y*. Therefore, the same reference numerals are given to the components, alphabetical letters "m," "c" and "b" are added to the ends of the respective reference numerals, and descriptions thereof will be omitted.

The toners 16*y*, 16*m*, 16*c* and 16*b* (generically referred to as the "toner 16" hereinafter unless otherwise specified) each contain a binder resin, a colorant and a release agent.

No particular limitation is imposed on the selection of the binder resin so long as it can be softened or swelled by a fixing fluid 32 described later. The binder resin is, for example, polystyrene, a homopolymer of a styrene derivative substitution, a styrene-based copolymer, polyvinyl chloride, polyvinyl acetate, polyethylene, polypropylene, polyester, and polyurethane. The aforementioned binder resins may be used each alone, or two or more thereof may be used in combination. Among the aforementioned binder resins, a binder resin that has a softening temperature of 100° C. to 150° C. and a glass transition temperature of 50° C. to 80° C. is preferable as the binder resin for color toner, in consideration of preservation property, durability, control of the softening or swelling effect produced by the fixing fluid 32 described later, and so on. Polyester, which has a softening temperature and a glass transition temperature within the aforementioned ranges, is particularly preferable. Polyester is easily softened and/or swelled by an easily-available organic solvent, and becomes transparent in the softened and/or swelled state. In a case where polyester is used as the binder resin, polyester itself becomes transparent when a multicolor toner image obtained by superimposing toner images of yellow, magenta, cyan, and black one upon another is fixed to a recording medium 8 with the fixing fluid 32. This makes it possible to attain excellent coloration in accordance with a subtractive color mixing process. Moreover, image fixation using the fixing fluid 32 can be achieved also in the case of using a resin material such as that which is higher in softening point and in hardness than a binder resin to be contained in a toner for use in the heat fixing method. The use of a resin material having a high softening point and a high hardness makes it possible to prevent image degradation resulting from application of a load in development, and thereby obtain high-quality images, each of which quality will be less deteriorated for a longer period of time.

As the colorant, it is possible to use pigments and dyes adaptable to toner formation that have conventionally been used in electrophotographic image formation. In particular, the use of a pigment material which is insoluble in the fixing fluid 32 is desirable from the standpoint of preventing the occurrence of smearing resulting from the application of the fixing fluid 32, for example, when a toner image is transferred and fixed to the recording medium 8. The pigment is, for example: an organic pigment such as an azo pigment, a benzimidazolone pigment, a quinacridone pigment, a phthalocyanine pigment, an isoindolinon pigment, an isoindolin pigment, a dioxazine pigment, an anthraquinone pigment, a perylene pigment, a perinon pigment, a thioindigo pigment, a quinophthalone pigment and a metal complex pigment; an inorganic pigment such as carbon black, titanium oxide, molybdenum red, chrome yellow, titanium yellow, chromium oxide and Berlin blue; and metal powder such as aluminum powder. The aforementioned pigments may be used each alone, and two or more of the aforementioned pigments may be used in combination. As the release agent, it is possible to use wax, for example. It is possible to use wax used commonly in this field. In particular, it is preferable to use wax softened or swelled by the fixing fluid 32. Such wax is, for example, polyethylene wax, polypropylene wax and paraffin wax.

The toner 16 may contain one or two or more of the commonly-used toner additives such as a charge control agent, a flowability enhancer, a fixation accelerator, and a conducting agent, other than the binder resin, the colorant and the release agent. It is possible to produce the toner 16 by a well-known method such as: a pulverization method of melting and kneading the colorant, the release agent and so on with the binder resin, and subjecting the admixture to pulverization; a suspension polymerization method of uniformly dispersing the colorant, the release agent, a monomer of the binder resin and so on, and thereafter, polymerizing the monomer of the binder resin; and an emulsion aggregation method of aggregating particles of the binder resin, the colorant, the release agent and so on with an aggregating agent, and heating fine particles of an obtained aggregate. As the shape of a particle of the toner 16, an irregular shape is preferable to a complete sphere, in order to obtain a larger surface area. With this shape, the toner becomes easy to come in contact with the fixing fluid 32. Therefore, it is possible to reduce the amount of the consumed fixing fluid 32, and it is also possible to fix and dry a toner image in a short time.

A preferable volume average particle diameter of the toner 16 is 2 to 7 μm, though there is no particular limitation. Since the use of such toner having a small diameter realizes a large surface area per unit area of a toner image and thereby increases the contact area with the fixing fluid 32, it is possible to fix the toner image to the recording medium 8 in a short time. Fixing in a short time contributes to reduction of the amount of the consumed fixing fluid 32. Moreover, since the fixing fluid 32 is rapidly dried up, the recording medium 8 is prevented from having wrinkles, curls, or the like troubles. In a case where the volume average particle diameter of the toner 16 is reasonably small, a toner coverage rate with respect to the recording medium 8 per unit weight is high. Therefore, it is possible to form a high-quality image with a small amount of toner consumed. That is to say, the reduction of the amount of the consumed toner can be consistent with the formation of high-quality images. When the volume average particle diameter of the toner 16 is less than 2 μm, the flowability of the toner 16 is so low that none of supply, agitation, and charge of the toner 16 can be achieved successfully during a development process. As a result, problems such as shortages of the toner or an undesirable increase of toner having an opposite polarity (reverse-polarity toner) arise, posing the risk of producing an image of poor quality. By way of contrast, when the volume average particle diameter of the toner exceeds 7 μm, many of the toner particles have a large particle diameter and the center of the toner particles is hardly softened and/or swelled. This leads to poor fixability of toner image with respect to the recording medium 8, as well as to an image of poor color. In the case of performing image fixation on an OHP film in particular, quite inconveniently, a transferred image may be gloomy.

Although a softening temperature and glass transition temperature of the toner 16 are not limited to particular levels, it is preferred that the softening temperature be 100° C. to 130° C. and the glass transition temperature be 50° C. to 80° C. Although such toner having a high softening temperature is preferable in order to increase load durability at the time of development, the toner is not sufficiently fixed into place or does not give sufficient coloration in the heat fixing method. Since the toner is chemically softened and/or swelled by using the fixing fluid 32, the toner is sufficiently fixed into place and gives sufficient coloration so that a high-definition image can be obtained. In a case where the toner 16 contains a plurality of binder resins, the toner 16 may exhibit a plurality of softening temperatures or a plurality of glass transition temperatures. In this case, the softening temperature of the toner refers to the lowest temperature among the plurality of softening temperature, and the glass transition temperature of the toner refers to the lowest temperature among the plurality of glass transition temperatures.

In the present embodiment, the toners 16 each have the following constitution in common except the pigments. The toner 16 is designed as an insulative non-magnetic toner to be negatively charged, which has a glass transition temperature of 60° C., a softening temperature of 120° C. and a volume average particle diameter of 6 μm. In order to obtain, by using the aforementioned toner, an image density of 1.4 that is a reflection density value measured by a reflection densitometer type 310 manufactured by X-Rite Corporation, it is necessary to use the toner in an amount of 5 g/m$^2$. The toner 16 contains: polyester (the binder resin), which has a glass transition temperature of 60° C. and a softening temperature of 120° C.; low-molecular-weight polyethylene wax (the release agent), which has a glass transition temperature of 50° C. and a softening temperature of 70° C.; and the pigment of each color. The wax accounts for 7% by weight of the total amount of the toner, the pigment accounts for 12% by weight of the total amount of the toner, and polyester of the binder resin accounts for the rest. The low-molecular-weight polyethylene wax contained in the toner 16 is wax whose glass transition temperature and softening temperature are lower than those of polyester of the binder resin. In a case where such wax is used, adhesion of the toner and adhesion of the toner to the intermediate transfer belt 21 or the recording medium 8 are high even at a temperature lower than the glass transition temperature of the binder resin. Therefore, at the time of application of the liquid fixing fluid 32, it is possible to inhibit the toner from being disturbed or aggregated by the fixing fluid 32. Moreover, when the wax contained in the toner is softened, the fixing fluid 32 easily penetrates into the toner from a part where the wax exists. Therefore, the toner is entirely softened and/or swelled in a short time at the time of application of the fixing fluid 32, a sufficient fixing level is obtained at the time of transfer to the recording medium 8, and color development by superimposition of toner images becomes sufficient.

The intermediate transfer section 3 includes the intermediate transfer belt 21, intermediate transfer rollers 22*y*, 22*m*, 22*c* and 22*b*, supporting rollers 25, 26 and 27, and a belt cleaner 28. The intermediate transfer belt 21 is an endless belt-shaped toner image bearing member that is stretched across the supporting rollers 25, 26 and 27 and formed in a loop shape and that rotates in the direction of arrow 29 at almost the same circumferential velocity as the photoreceptor drums 11*y*, 11*m*, 11*c* and 11*b*. For the intermediate transfer belt 21, it is possible to use, for example, a polyimide film having a thickness of 100 μm. Moreover, it is possible to form an elastic layer on a surface layer of the polyimide film so that the polyimide film transforms according to unevenness of the surface of a toner image or the recording medium 8. A preferable thickness of the elastic layer is about 0.5 to 2 mm.

Furthermore, in order to inhibit the adhesive force between the softened and/or swelled toner 16 and the intermediate transfer belt 21 from becoming higher than necessary, a coating layer having a thickness of 20 μm composed of a fluororesin composite containing PTFE (polytetrafluoroethylene) and PFA (a copolymer of tetra fluoroethylene and perfluoro alkyl vinyl ether) at a ratio of 8 to 2 (a weight ratio) may be formed on the surface of the polyimide film. In the polyimide film and the coating layer, a conducting material such as furnace black, thermal black, channel black and graphite carbon is mixed in order to regulate a value of electric resistance of the intermediate transfer belt 21. The surface of the coating layer is a toner image bearing face 21*a* of the intermediate transfer belt 21. The material of the intermediate transfer belt 21 is not limited to the aforementioned one, and any material can be used without any particular limitation as far as the material does not allow the fixing fluid 32 to penetrate through. For example, the intermediate transfer belt may be obtained by forming a coating layer composed of at least one ingredient selected from PTFE, PFA and ETFE, on a film of polycarbonate, fluororubber and the like to which conductive coating is applied. Moreover, by impregnating a base member of the belt or the elastic layer of the belt with fluorine, releasability of the coating layer may be increased.

The toner image bearing face 21*a* of the intermediate transfer belt 21 is brought into pressure-contact with the photoreceptor drums 11*y*, 11*m*, 11*c* and 11*b* in this order from an upstream side in a rotation direction of the intermediate transfer belt 21. Positions in which the intermediate transfer belt 21 is brought into pressure-contact with the photoreceptor drums 11*y*, 11*m*, 11*c* and 11*b* are positions for intermediate transfer of toner images of the respective colors. The intermediate transfer rollers 22*y*, 22*m*, 22*c* and 22*b* are placed at positions opposite to the photoreceptor drums 11*y*, 11*m*, 11*c* and 11*b* across the intermediate transfer belt 21.

The intermediate transfer rollers 22*y*, 22*m*, 22*c*, and 22*b* formed as roller-shaped members are arranged face to face with the photoreceptor drums 11*y*, 11*m*, 11*c*, and 11*b*, respectively, with the intermediate transfer belt 21 lying therebetween. The intermediate transfer rollers 22*y*, 22*m*, 22*c*, and 22*b* are each brought into pressure-contact with the surface of the intermediate transfer belt 21 opposite to the toner image bearing surface 21*a*, and are each rotated about their axes by a driving mechanism (not illustrated). For example, the intermediate transfer rollers 22*y*, 22*m*, 22*c*, and 22*b* are each constructed of a roller member composed of a metal-made shaft body having its surface covered with an electrically conductive layer. The shaft body is made of a metal material, for example, stainless steel. Although the diameter of the shaft body is not particularly limited, preferably it is set to fall in a range of from 8 mm to 10 mm. The electrically conductive layer is made of an electrically conductive elastic element, for example. As the electrically conductive elastic element, those used customarily in this field can be used. The conductive elastic material is, for example, EPDM, foamed EPDM, and foamed urethane that contain a conductivity control agent such as carbon black.

By virtue of the electrically conductive layer, a high voltage is uniformly applied to the intermediate transfer belt 21. In order for toner images formed on the surfaces of the photoreceptor drums 11*y*, 11*m*, 11*c*, and 11*b* to be transferred onto the intermediate transfer belt 21, an intermediate transfer bias of a polarity reverse to the polarity of the charged toner is impressed on the intermediate transfer rollers 22*y*, 22*m*, 22*c*, and 22*b* under constant-voltage control. In this way, the toner images of four colors: yellow; magenta; cyan; and black formed on the surfaces of the photoreceptor drums 11*y*, 11*m*, 11*c*, and 11*b*, respectively, are transferred and overlaid onto the toner image bearing surface 21*a* of the intermediate transfer belt 21 one after another, whereupon a multi-color toner image is formed. Note that, in a case where only part of the yellow-color image data, the magenta-color image data, the cyan-color image data, and the black-color image data is inputted, among the image forming units 10*y*, 10*m*, 10*c*, and 10*b*, only the one/ones corresponding to the input image data is/are operated to achieve toner image formation.

The supporting rollers 25, 26 and 27 are rotatably disposed around axes thereof by a driving mechanism (not illustrated), across which the intermediate transfer belt 21 is stretched and rotates in the direction of arrow 29. For example, the supporting rollers 25, 26 and 27 are each constructed of an aluminum-made cylinder (a pipe-shaped roller) which is 30 mm in diameter and 1 mm in wall thickness. Inside the supporting roller 25, a heating section 31 is disposed and preheats the intermediate transfer belt 21 and a toner image on the intermediate transfer belt 21. The heating section 31 is capable of heating the toner image, thereby increasing toner-to-toner binding force of the toner 16 in the toner image, and preventing the toner 16 from flowing or aggregating when the fixing fluid is applied to the toner image from the fixing fluid applying section 4 placed downstream of the supporting roller 25 in the rotation direction of the intermediate transfer belt 21. In other words, the heating section 31 is used as a section for increasing the toner-to-toner binding force. As the heating section 31, it is possible to use a well-known heating section supplied with electric power and generating heat, such as a halogen lamp and an infrared heater. Although it is possible to properly change the amount of the electric power supplied to the heating section 31 according to various conditions such as the kind of the toner 16, the material and thickness of the intermediate transfer belt 21 and a process speed, the control is preferably performed so that the surface temperature of the intermediate transfer belt 21 falls in a range of 90° C. to 120° C. when the intermediate transfer belt 21 is moving away from the supporting roller 25. The supporting roller 26 is brought into pressure-contact with a transferring and fixing roller 30 described later via the intermediate transfer belt 21 and forms a transferring and fixing nip area, and is electrically grounded. The supporting roller 26 has both a function of stretching thereon the intermediate transfer belt 21, and a function of transferring and fixing a toner image on the intermediate transfer belt 21 to the recording medium 8.

After the toner image on the toner image bearing face 21*a* of the intermediate transfer belt 21 has been transferred to the recording medium 8 in a transferring and fixing section 5 described later, some toner remains on the toner image bearing face 21*a*. The belt cleaner 28 is a member that removes such a toner remaining on the toner image bearing face 21*a*. The belt cleaner is disposed so as to face the supporting roller 27 via the intermediate transfer belt 21, and brought into pressure-contact with the toner image bearing face 21*a* of the intermediate transfer belt 21 by a pressing section (not illustrated). The belt cleaner 28 includes a cleaning blade 28*a* that scrapes off the toner and the like remaining on the toner image bearing face 21*a*, and a toner storage container 28*b* that stores the toner and the like scraped off by the cleaning blade 28*a*. As the cleaning blade 28*a*, it is possible to use a blade made of, for example, a rubber material such as urethane rubber, which has elasticity.

In the intermediate transfer section 3, toner images formed on the photoreceptor drums 11*y*, 11*m*, 11*c* and 11*b* are transferred and overlaid in a predetermined position of the toner image bearing face 21*a* of the intermediate transfer belt 21, whereby a toner image is formed. As described later, the toner image receives the application of the fixing fluid 32 from the fixing fluid applying section 4 so that the toner 16 constituting the toner image is softened and/or swelled. The toner image is then transferred and fixed to the recording medium 8 at the transferring and fixing nip area. The belt cleaner 28 removes toner remaining on the toner image bearing face 21*a* of the intermediate transfer belt 21 after transfer and fixation, offset toner, paper dust, and so on. And then, transfer of toner images to the toner image bearing face 21*a* is executed again.

The fixing fluid applying section 4 is an electrostatic atomization apparatus for applying the fixing fluid 32 to an unfixed toner image on and conveyed by the intermediate transfer belt 21. The fixing fluid applying section is disposed between a position at which a toner image is transferred to the intermediate transfer belt 21 by the toner image forming section 2 and a position (the transferring and fixing nip area) at which toner image is transferred and fixed to the recording medium 8 by the transferring and fixing section 5, in the rotation direction of the intermediate transfer belt 21 (the direction of arrow 29). The fixing fluid applying section includes a fixing fluid tank 33, a fixing fluid conveying member 35, an electrode 36 which a voltage is applied, a counter electrode 37, and an air flow control member 38.

The fixing fluid tank 33 supports the electrode 36 and the counter electrode 37, and has a fixing fluid storage portion 34 for storing the fixing fluid 32, in a lower part in the vertical direction. A side wall 33*a* is disposed face to face with a side wall 33*b* when seen in a transverse direction of the fixing fluid tank 33. The side wall 33*b* is provided with the air flow control member 38. The side wall 33*a* curves so as to come close to the side wall 33*b* as extending upward in the vertical direction, and an end portion of the side wall 33*a* is positioned away from the intermediate transfer belt 21 with such a distance therebetween that a toner image on the intermediate transfer belt 21 can pass without coming into contact with the end portion. Between a position at which the energized electrode 36 contacts the side wall 33*a* and a position at which the counter electrode 37 contacts the side wall 33*a* along a longitudinal direction of the side wall portion 33*a*, a plurality of air inlets 40 are formed. Although the shape of the air inlet 40 is a rectangular in the present embodiment, the air inlet may be formed into a shape of a circle, an oval, a polygon and so on, without being limited to the rectangular shape. A fixing fluid supply pump (not illustrated) and a fixing fluid-containing tank (not illustrated) are connected to the fixing fluid tank 33 via a fixing fluid supply tube (not illustrated) and, in response to a result of detection produced by a solution amount detecting sensor (not illustrated) disposed in the fixing fluid tank 33, the fixing fluid 32 is supplied from the fixing fluid-containing tank so that the surface of the fixing fluid in the fixing fluid storage portion 34 is kept at a constant height. Otherwise, without being limited to the above, it is possible to employ a cartridge system in which the fixing fluid tank 33 is replaced with a new one when the fixing fluid 32 in the fixing fluid storage portion 34 is exhausted.

The fixing fluid conveying member 35 is a hollow rod-shaped member that has openings at both ends and has a fixing fluid conveyance path connected to both the openings inside. The fixing fluid conveying member is supported by the energized electrode 36 so that one end portion is immersed in the fixing fluid 32 stored in the fixing fluid storage portion 34 and an end portion of the other end portion faces the toner image bearing face 21*a* of the intermediate transfer belt 21, and conveys the fixing fluid 32 from the one end portion to the other end portion by a capillary phenomenon or the like. Moreover, the fixing fluid conveying member 35 is disposed so that the one end portion does not contact the bottom face in the vertical direction of the fixing fluid tank 33. Furthermore, the fixing fluid conveying member 35 is disposed so that at least the end portion of the other end portion protrudes from the energized electrode 36 in a direction of conveyance of the fixing fluid. It is preferred that at least the end portion of the other end portion be formed into a needle-like shape. Consequently, it is possible to reduce the droplet diameter of the fixing fluid 32, and it is possible to selectively supply droplets of the fixing fluid to a toner image in a more favorable manner.

A plurality of fixing fluid conveying members 35 are placed in a line in a longitudinal direction of the fixing fluid tank 33. An interval between the adjacent fixing fluid conveying members 35 can be properly selected according to various conditions such as an angle of the end portion of the other end of the fixing fluid conveying member 35 (spreadability of the fixing fluid 32), a distance between the toner image beaining face 21*a* of the intermediate transfer belt 21 and the end portion of the other end of the fixing fluid conveying member 35, and an image forming speed. In the present embodiment, twelve fixing fluid conveying members 35 are lined up at 20 mm intervals. For the fixing fluid conveying members 35, it is possible to use a rod-shaped porous material, one or a plurality of capillary tubes, and the like. The rod-shaped porous material is obtained by, for example, forming porous ceramic whose major constituent is alumina, zirconia or the like into a rod-like shape. Although general porous ceramic is an insulating material, it is also possible to use conductive porous ceramic obtained by finely dispersing particles of conductive ceramics into porous oxide made of alumina, zirconia or the like, semi-conductive porous ceramic, and the like. As the capillary tube, it is possible to use, for example, a metal-made capillary tube and a synthetic resin-made capillary tube. The fixing fluid conveying member 35 conveys the fixing fluid 32 by the capillary phenomenon or the like, from the one end portion immersed in the fixing fluid 32 to the other end portion facing the toner image bearing face 21*a* of the intermediate transfer belt 21. The fixing fluid 32 conveyed to the other end portion becomes droplets by surface tension at the end portion of the other end portion, thereby becoming exposed outward. The droplets of the fixing fluid 32 are made into minute droplets by an electric field generated between the energized electrode 36 and the counter electrode 37 as described later, and conveyed by air flow.

The energized electrode 36 is horizontally supported at such a position that the energized electrode 36 does not contact the surface of the fixing fluid 32 stored in the fixing fluid storage portion 34, by both side walls along the transverse direction of the fixing fluid tank 33. Formed in a line in a longitudinal direction of the energized electrode 36 are fixing fluid-conveying member insertion holes (not illustrated) that are vertical through holes. The fixing fluid conveying members 35 are inserted into the fixing fluid conveying member insertion holes, whereby the fixing fluid conveying members 35 are supported. As the energized electrode 36, it is possible to use an electrode made of an electrically conductive material. The electrically conductive material is, for example, a conductive resin composite including synthetic resin and an electrically conductive material such as carbon black, a conductive whisker and an electrically conductive metal oxide, and an electrically conductive metal such as stainless steel. To the energized electrode 36 is connected a high-voltage generating apparatus (not illustrated) and is applied a voltage of which polarity is reverse to that of a charged toner image. In the present embodiment, a voltage of +5 to +6 kV is applied. By regulating a voltage applied to the energized electrode 36, it is possible to properly select the amount of the fixing fluid 32 which will be made into minute droplets.

The counter electrode 37 is horizontally supported by the side wall 33*a* of the fixing fluid tank 33 so that the counter electrode 37 faces the energized electrode 36 and positioned away from the end portion of the other end of the fixing fluid conveying member 35. As the counter electrode 37, an electrode member is used that is formed into a mesh-like shape when seen from above and that has fixing fluid droplet flowing holes (not illustrated) which are vertical through holes. Roughness of the mesh of the electrode member is not limited particularly so long as it is rough enough for the fixing fluid droplets to pass through without hindrance. Consequently, a flow of air including the minute droplets of the fixing fluid 32 flows through toward a toner image on the intermediate transfer belt 21. When forming the counter electrode 37, it is possible to use the same electrically conductive material as that for forming the energized electrode 36. Although an electrode member having a mesh-like shape is used as the counter electrode 37 in the present embodiment, it is possible to use any electrode member without particular limitation as far as the electrode member has vertical through holes that allow the fixing fluid droplets to pass through without hindrance.

When a high voltage is applied to the energized electrode 36, an electric field is generated between the energized electrode 36 and the counter electrode 37, and the electric field concentrates on the droplets of the fixing fluid 32 exposed outward after conveyed to the end portion of the other end of the fixing fluid conveying member 35. The degree of concentration of the electric field is large in a case where the end portion of the other end has a needle-like shape. Charge is injected into the droplets of the fixing fluid 32. When the charge of the droplets exceeds the Rayleigh limit, the droplets become unstable, and one or a plurality of minute droplets that are strongly charged are released from the droplets. These minute droplets are carried by the air flow and, by the charge of the minute droplets as well as control of the air flow by the air flow control member 38 described later so as to flow through toward a toner image on the intermediate transfer belt 21, the minute droplets are selectively supplied to the toner image.

The air flow control member 38 is a roller-shaped member supported so as to be capable of rotating in a direction of arrow 39. The air flow control member is disposed downstream of the fixing fluid tank 33 in the rotation direction of the intermediate transfer belt 21 so as not to prevent the intermediate transfer belt from rotating, so as to be isolated with a minute space from an upper end portion of the side wall 33*b* of the fixing fluid tank 33 and a side end portion of the side wall 33*b* along a direction horizontal to the counter electrode 37, and so as to be isolated with a gap from the intermediate transfer belt 21. The gap between the intermediate transfer belt 21 and the air flow control member is, for example, about 0.5 to 3 mm. The air flow control member 38 is thus placed and rotated in the direction of arrow 39, thereby taking in air from the air inlet 40 to generate an air flow. Consequently, it is possible to further intensively lead the flow of the air including the minute droplets of the fixing fluid 32 into the gap between the air flow control member 38 and the intermediate transfer belt 21. Then, the toner image on the intermediate transfer belt 21 is conveyed into the gap and receives application of the minute droplets of the fixing fluid 32. It is thus possible to selectively supply the minute droplets of the fixing fluid 32 to the toner image so that the toner image is swelled and/or softened. The higher the image forming speed is, in particular, the more effectively the air flow control member 38 as described above works.

The fixing fluid 32 is a liquid matter that softens and/or swells the toner 16. As the fixing fluid 32, such a fixing fluid is preferable that contains an organic compound having an effect of softening and/or swelling the toner 16 (referred to as the "toner fixing organic compound" hereinafter) and a solvent component capable of dissolving or dispersing the toner fixing organic compound.

The toner fixing organic compound is, for example: alcohols such as methyl alcohol, ethyl alcohol, propyl alcohol, isopropyl alcohol and butyl alcohol; ketones such as acetone, methyl ethyl ketone, methyl butyl ketone, methyl isobutyl ketone and diethyl ketone; ethers such as methyl ethyl ether, diethyl ether, methyl butyl ether, methyl isobutyl ether and dimethyl ether; and esters of carboxylic acid such as formic acid, acetic acid, propionic acid and butyric acid and alcohols such as methanol, ethanol and propanol. Among these compounds, ethers and esters are preferable, and esters are preferable in particular. Among ethers, diethyl ether is preferable in specific. Among esters, ethyl acetate, methyl acetate, methyl formate, ethyl formate and the like are preferable, and ethyl acetate is preferable in particular. The toner fixing organic compounds may be used each alone, and two or more of the toner fixing organic compounds may be used in combination.

The toner fixing organic compound has volatility at normal temperatures, and has an excellent effect of softening and/or swelling the toner binder resin such as polyester. Although it is possible to properly select the content of the toner fixing organic compound in the fixing fluid 32 from a wide range without particular limitation, a preferable content is 1% to 50% by weight of the total quantity of the fixing fluid 32, a more preferable content is 5% to 50% by weight of the total quantity of the fixing fluid 32, and a most preferable content is 10% to 40% by weight of the total quantity of the fixing fluid 32. In a case where the content is less than 1% by weight, the toner fixing organic compound cannot sufficiently exhibit the effect of softening and/or swelling the toner 16, which may result in a decrease in fixing level of a toner image to the recording medium 8. On the other hand, in a case where the content exceeds 50% by weight, the content of the solvent component is relatively small, with the result that permeability of the fixing fluid 32 to a toner image is low, and only a surface layer of the toner image is softened and/or swelled, which may result in a decrease in fixing level of the toner image to the recording medium 8.

Although the solvent component is not particularly limited as far as the solvent component is a liquid component capable of dissolving or dispersing the toner fixing organic compound, hydrofluoroethers, namely, partially fluorinated ethers, are preferable in consideration of permeability to a toner image, and so on. Hydrofluoroethers have low surface tension and viscosity, and hence, penetrates well into gaps formed by the toner particles and through a contact face between the toner and the recording medium 8. Therefore, the toner fixing organic compound can be carried with hydrofluoroethers to the gaps formed by the toner particles or onto the contact face between the toner and the recording medium 8, thereby softening and/or swelling the toner instantly. Moreover, hydrofluoroethers volatilize in a short time even at room temperature because latent heat of vaporization thereof is small, with the result that the recording medium 8 is dried up fast. It is possible to use well-known hydrofluoroethers, such as methyl nonafluorobutyl ether, methyl nonafluoroisobutyl ether ($C_4F_9OCH_3$), ethyl nonafluorobutyl ether, ethyl nonafluoroisobutyl ether ($C_4F_9OC_2H_5$), 1,1,2,2-tetrafluoroethyl 2,2,2-trifluoroethyl ether ($CHF_2CF_2OCH_2CF_3$). The above hydrofluoroethers may be used each alone, or two or more of the above hydrofluoroethers may be used in combination. Although it is possible to properly select the content of the hydrofluoroether in the fixing fluid 32 from a wide range without particular limitation, a preferable content is 50% to 99% by weight of the total quantity of the fixing fluid 32, a more preferable content is 50% to 95% by weight of the total quantity of the fixing fluid 32, and a most preferable content is 60% to 90% by weight of the total quantity of the fixing fluid 32. In a case where the content is less than 50% by weight, permeability of the fixing fluid 32 to a toner image is low, only a surface layer of the toner image is softened and/or swelled, which may thus result in a decrease in fixing level of the toner image to the recording medium 8. On the other hand, in a case where the content is more than 99% by weight, the content of the toner fixing organic compound is relatively small, and a softening and/or swelling effect of the fixing fluid 32 to the toner is low, which may result in an insufficient level of fixing strength of the toner image to the recording medium 8.

To the fixing fluid 32, it is possible to add a surfactant that keeps the toner fixing organic compound in a dispersed state in water and increases wettability of the fixing fluid 32 with the toner, other than the toner fixing organic compound and the solvent component. As the surfactant, it is possible to use a well-known one, for example, an anionic surfactant such as fatty acid derivative sulfate and phosphoric ester, a cationic surfactant such as quaternary ammonium salt and heterocyclic amine, a zwitterionic surfactant such as amino acid ester and amino acid, a nonionic surfactant, polyoxyalkylene alkylether, and polyoxyethylene alkylamine.

In the fixing fluid applying section 4, by a flow of air taken in the fixing fluid tank 33 through the air inlet 40 by rotation of the air flow control member 38, the minute droplets of the fixing fluid 32 formed in the fixing fluid tank 33 and charged to a reverse potential to that of a toner image are intensively carried to the gap between the air flow control member 38 and the intermediate transfer belt 21, and the minute droplets of the fixing fluid 32 are selectively supplied to the toner image conveyed to the gap, whereby the toner image is swelled and/or softened. Although an electrostatic atomization apparatus is used as the fixing fluid applying section 4 in the present embodiment, it is also possible to use an applying apparatus using an inkjet head, an ultrasonic oscillator and the like without being limited to the electrostatic atomization apparatus.

The transferring and fixing section 5 includes the supporting roller 26 and the transferring and fixing roller 30. The transferring and fixing roller 30 is a roller-shaped member that makes pressure-contact with the supporting roller 26 via the intermediate transfer belt 21 and is rotatably disposed around an axis thereof, and functions mainly as a pressing roller. As the transferring and fixing roller 30, a roller commonly used in this field may be used, and in the present embodiment, a roller-shaped member is used which is obtained by forming a 4 mm-thick urethane rubber layer on the circumference of a 10 mm-diameter metal core. Moreover, in the present embodiment, the transferring and fixing roller 30 is pressurized against the supporting roller 26 via the intermediate transfer belt 21 at a linear pressure of 5 N/cm. When a softened and/or swelled toner image on the intermediate transfer belt 21 is conveyed to the transferring and fixing nip area that is a pressure-contact area between the supporting roller 26 and the transferring and fixing roller 30, the recording medium 8 is simultaneously fed from the recording medium feeding section 6 described later. Then, the toner image and the recording medium 8 are pressurized in an overlaid state so that the toner image is transferred and fixed. Since the toner image is in the softened and/or swelled state as described above, the toner image is adhered to the recording medium 8 by pressurization. In a case where the recording medium 8 is paper, the toner image deeply penetrates paper fiber at the time of adhesion, and simultaneously, the toner particles are fused with each other, whereby the surface of the toner image becomes smooth. As a result, it is possible to obtain a high-definition color image that is excellent in coloration developed by the subtractive color mixing process and in glossiness of the surface. In the present embodiment, almost all toner of the toner image is transferred to the recording medium 8 when the surface of the intermediate transfer belt 21 has a fluororesin layer having a small adhesion to the toner 16. Moreover, in a case where an elastic layer is formed under the fluororesin layer, the intermediate transfer belt 21 transforms in response to unevenness of the surface of the recording medium 8. Therefore, the toner image can be brought into contact with depressed portions of the recording medium 8 as well so that an evenly transferred and fixed image can be obtained. At this moment, in order to assist in transferring and fixing the toner image, it is possible to use a transferring and fixing roller like the transferring and fixing roller 30, on a surface of which an urethane rubber layer containing an electrically conductive material such as carbon is formed so that the surface exhibits conductivity and of which metal core may receive application of a voltage of, for example, +1 kV. This allows the toner image on the intermediate transfer belt 21 to be more smoothly transferred and fixed to the recording medium 8.

The recording medium feeding section 6 includes a recording medium cassette 42, a pickup roller 43, and registration rollers 44*a* and 44*b*. The recording medium cassette 42 stores the recording medium 8. The recording medium 8 is, for example, plain paper, coated paper, color copy paper, an OHP (overhead projector) film, and a postcard. The size of the recording medium is, for example, A4 size, A3 size, B5 size, B4 size and postcard size. The pickup roller 43 sends and feeds the recording mediums 8 one by one to a conveyance path P. The registration rollers 44*a* and 44*b* are a pair of roller-shaped members disposed so as to be brought into pressure-contact with each other. The registration rollers send and feed the recording medium 8 to the transferring and fixing nip area, in synchronism with conveyance of a multicolor toner image on the intermediate transfer belt 21 to the transferring and fixing nip area. By the recording medium feeding section 6, the recording mediums 8 stored in the recording medium cassette 42 are sent and fed one by one to the conveyance path P by the pickup roller 43, and then sent and fed to the transferring and fixing nip area by the registration rollers 44*a* and 44*b*.

The scanner section 7 includes a document table 41, a light source (not illustrated), and a CCD sensor 9. On an upper face of the document table 41, a to-be-copied document is placed. A plate-shaped member made of a transparent material such as transparent glass is used for the document table 41. The light source illuminates the document placed on the document table 41. The CCD sensor 9 photoelectrically converts light reflected from the document illuminated by the light source, thereby converting the reflected light to image data (image signals). The CCD sensor 9 includes a converting portion, a transfer portion and an output portion. The converting portion converts light signals of the reflection light to electric signals. The transfer portion sequentially transfers the electric signals to the output portion in synchronism with clock pulses. The output portion converts the electric signals to voltage signals, amplifies the voltage signals, makes the signals low-impedance, and outputs the signals. The analog signals obtained in this manner are converted into digital signals by well-known image processing. The image data of the document read by the scanner section 7 is sent to a control unit 90 for controlling all operations of the image forming apparatus, where the image date is subjected to the various image processes. And thereafter, the image date is temporarily stored in a memory. In response to an output command, the image stored in the memory is read out and transferred to the light scanning unit 13, whereby the image is formed on a recording sheet of the recording medium 8.

The image forming apparatus 1 has the control unit 90. The control unit 90 is placed, for example, in an upper part of an internal space of the image forming apparatus 1. The control unit 90 includes a control portion, a calculation portion, and a storage portion, and constitutes a processing circuit realized by, for example, a microcomputer having a central processing unit (CPU). To the storage portion of the control unit 90 are inputted, for example, an image forming command through an operation panel (not illustrated) placed on an upper face of the image forming apparatus 1, detection results from sensors and the like (not illustrated) placed in various places inside the image forming apparatus 1, and image data given by the external equipment. The calculation portion executes determination based on the inputted various data (the image forming command, the detection results, the image data and so on), and the control portion sends a control signal in accordance with the result of determination by the calculation portion. All of the operations of the image forming apparatus 1 are thus controlled. As the storage portion, it is possible to use a storage portion commonly used in this field, such as a read only memory (ROM), a random access memory (RAM), and a hard disk drive (HDD). As the external equipment, it is possible to use electric equipment and electronic equipment that can form or acquire image data and can be electrically connected to the image forming apparatus. The equipment is, for example, a computer, a digital camera, a television, a video recorder, a DVD recorder, and a facsimile apparatus. The control unit 90 includes a power supply as well as the aforementioned processing circuit, and the power supply supplies electric power to not only the control unit 90 but also the respective apparatuses inside the image forming apparatus 1.

The image forming apparatus 1 may comprise a moving section 45, and a movement control section. The moving section 45 supports the fixing fluid applying section 4 so as to be movable along the intermediate transfer belt 21. The movement control section controls a movement of the fixing fluid applying section 4 effected by the moving section 45, according to information on a toner image (the size of a toner image forming region, the ratio of the toner adhesion area in the toner image forming region, the number of layers of the toner image, and so on), a set process speed and a set amount of the applied fixing fluid, thereby properly changing a position for application of the fixing fluid 32 by the fixing fluid applying section 4. In this case, the control unit 90 is used as the movement control section. To the storage portion of the control unit 90 is inputted as a data table a relation of the toner image data, process speed and fixing fluid application amount to the position for application of the fixing fluid 32. The position for application of the fixing fluid 32 indicates how long it takes for the toner image to reach the transferring and fixing nip area after the application of the fixing fluid 32. The calculation portion of the control unit 90 takes out the toner image data, the process speed and the fixing fluid application amount from the storage portion, and determines an optimum position for application of the fixing fluid 32 from the aforementioned data table. In response to the result of determination by the calculation portion of the control unit 90, the control portion sends a control signal to a driving mechanism (not illustrated) that drives the moving section 45, and causes the moving section 45 to move the fixing fluid applying section 4 to the optimum position for application. Therefore, with a configuration including the moving section 45 and the movement control section, it is possible to easily realize a condition of adhesive force B>adhesive force A of the toner image at the transferring and fixing nip area.

Further, by controlling the fixing fluid application amount in the image forming apparatus 1, it becomes easier to realize the condition of adhesive force B>adhesive force A of the toner image at the transferring and fixing nip area. The fixing fluid application amount is controlled by changing a rotation speed of the air flow control member 38 in the fixing fluid applying section 4. In normal, as the rotation speed of the air flow control member 38 is increased, the fixing fluid application amount increases. The control unit 90 serves as a fixing fluid application amount control section. To the storage portion of the control unit 90 is inputted as a data table a relation of the image data and the rotation speed of the air flow control member 38 to the fixing fluid application amount. Moreover, a relation between a ratio of the actual adhesion area of the toner in a predetermined toner image forming region and an optimum application amount of the fixing fluid 32, and a relation between the number of layers of a toner image and the optimum application amount of the fixing fluid 32 are also inputted as data tables. The toner image forming region refers to a range in which image formation can be executed, which is set in every image forming apparatus according to the sizes of recording mediums used for image formation. The calculation portion of the control unit 90 takes out the ratio of the adhesion area of toner in the toner image forming region, and the number of the layers of the toner image, from the data of the image data inputted to the storage portion. Then, based on the taken-out values, the calculation portion determines the optimum application amount from the data tables of the storage portion, and further, determines a rotation speed of the air flow control member 38 for obtaining the optimum application amount. According to the result of determination by the calculation portion, the control portion of the control unit 90 sends a control signal to a power supply (not illustrated) that supplies electric power to a driving mechanism (not illustrated) that rotates the air flow control member 38, and controls the rotation speed of the air flow control member 38. Consequently, it is possible to properly change the fixing fluid application amount according to a toner image on the intermediate transfer belt 21, and send the toner image to the transferring and fixing nip area in the condition of adhesive force B>adhesive force A.

The control unit 90 is capable of properly selecting various process speeds (mainly the process speeds of the photoreceptor drum 11 and the intermediate transfer belt 21) in the image forming apparatus according to the information regarding the toner image (the size of the toner image forming region, the ratio of the adhesion area of the toner in the toner image forming region, the number of the layers of the toner image, and so on), thereby controlling so that the toner image is brought into the condition of adhesive force B>adhesive force A at the transferring and fixing nip area. In other words, the control unit 90 also functions as a process speed control section. The process speed may be a rotation speed. In this case, a relation among the information regarding the toner image, the fixing fluid application amount, and the process speed is furthermore inputted as a data table to the storage portion of the control unit 90. The control portion of the control unit 90 takes out the fixing fluid application amount already set at the time of determination from the storage portion, and also takes out data on the number of layers of the toner image from the storage portion. Then, the control portion of the control unit 90 selects a process speed based on the aforementioned data table, and controls conditions of rotary drive of the photoreceptor drum 11 and the intermediate transfer belt 21. The rotary drive of the photoreceptor drum 11 is controlled by the driving mechanism of the photoreceptor drum 11. The rotary drive of the intermediate transfer belt 21 is controlled by the driving mechanisms of the supporting rollers 25, 26 and 27. Also by using the process speed control section, it is possible to realize the condition of adhesive force B>adhesive force A of the toner image at the transferring and fixing nip area.

In the image forming apparatus 1, a toner image is formed by the toner image forming section 2 according to the image data, and a thus-obtained toner image is then transferred to the intermediate transfer belt 21 and preheated by the supporting roller 25, thereafter receiving application of the fixing fluid 32 through the fixing fluid applying section 4 so that the toner is swelled and/or softened, which then results in the relation of adhesive force B>adhesive force A in the transferring and fixing section 5 so that the toner image is securely transferred and fixed to the recording medium 8.

Figure 5:
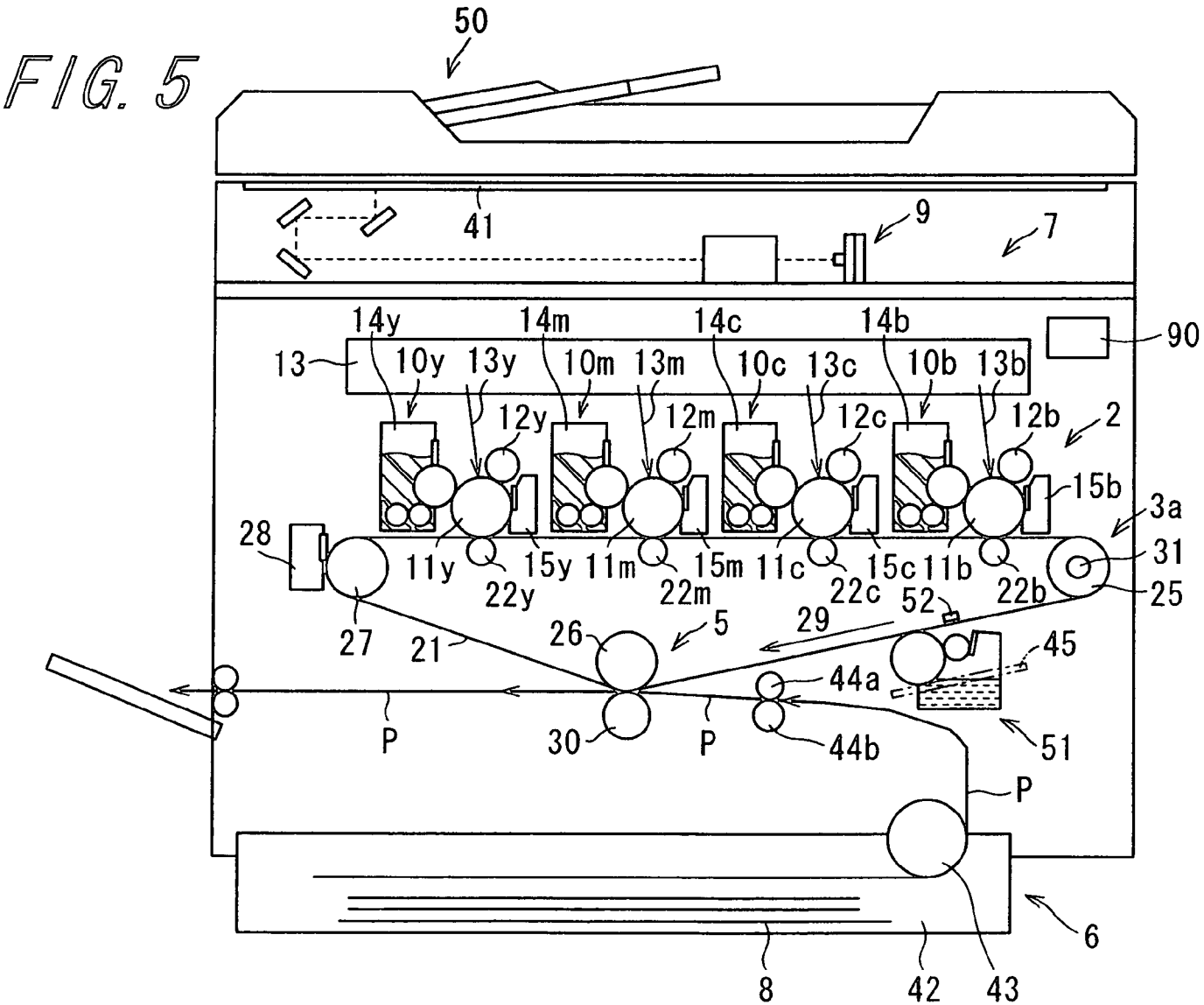
FIG. 5 is a sectional view schematically showing the constitution of an image forming apparatus according to a second embodiment.
Figure 6:
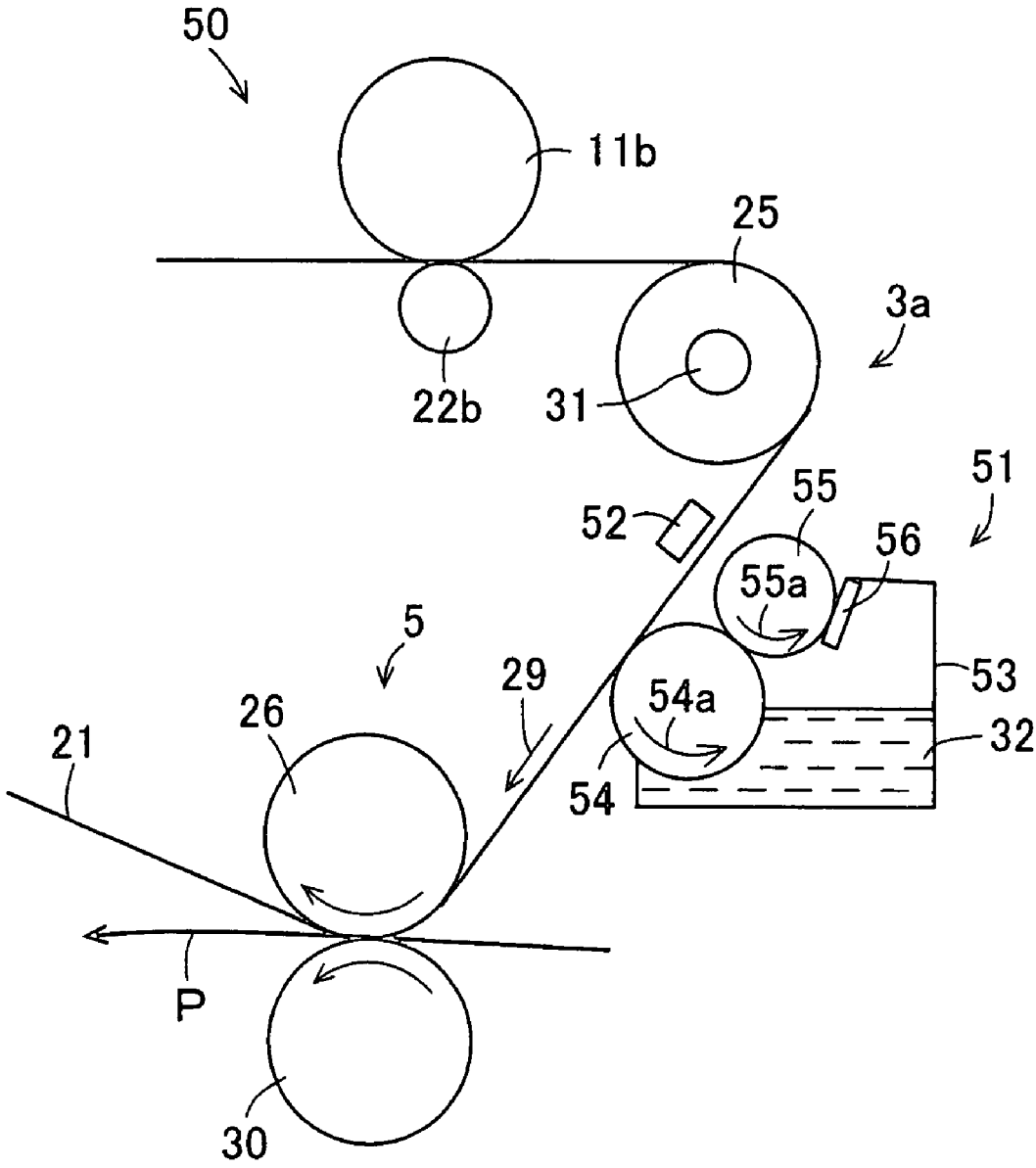
FIG. 6 is an enlarged sectional view showing the structure of principal portion of the image forming apparatus depicted in FIG. 5.

FIG. 5 is a sectional view schematically showing the constitution of an image forming apparatus 50 according to a second embodiment. FIG. 6 is an enlarged sectional view showing the structure of principal portion (in specific, a fixing fluid applying section 51 described later) of the image forming apparatus 50 illustrated in FIG. 5. Since the image forming apparatus 50 is similar to the image forming apparatus 1, corresponding portions will be denoted by the same reference numerals, and descriptions thereof will be omitted. The image forming apparatus 50 comprises an intermediate transfer section 3*a* instead of the intermediate transfer section 3 in the image forming apparatus 1. Moreover, the image forming apparatus 50 comprises a fixing fluid applying section 51 instead of the fixing fluid applying section 4 in the image forming apparatus 1.

The intermediate transfer section 3*a* includes a temperature detecting portion 52 as well as the intermediate transfer belt 21, the intermediate transfer rollers 22*y*, 22*m*, 22*c* and 22*b*, the supporting rollers 25, 26 and 27, and the belt cleaner 28. The temperature detecting portion 52 is placed downstream of the supporting roller 25 and upstream of the fixing fluid applying section 51 in the direction that the intermediate transfer belt 21 rotates (the direction of arrow 29), so as to be close to or in contact with a face opposite to the toner image bearing face 21*a* of the intermediate transfer belt 21. The temperature detecting portion 52 detects a surface temperature of the intermediate transfer belt 21. For example, a temperature sensor is used as the temperature detecting portion 52. The result of detection produced by the temperature detecting portion 52 is inputted to the control unit 90 that controls all operations of the image forming apparatus 50.

The result of detection produced by the temperature detecting portion 52 is inputted to the storage portion of the control unit 90. Further, a set value of the surface temperature of the intermediate transfer belt 21 is inputted to the storage portion. The calculation portion of the control unit 90 takes out the result of detection produced by the temperature detecting portion 52 and the set value of the surface temperature of the intermediate transfer belt 21, and determines which value is higher. According to the result of determination produced by the calculation portion that the detected value is lower than the set value of the surface temperature, the control portion of the control unit 90 sends a control signal to a power supply (not illustrated) that supplies electric power to the heating section 31, and controls an operation of supplying electric power from the power supply to the heating section 31. In normal, the operation is controlled so that the surface temperature of the intermediate transfer belt 21 which is moving away from the supporting roller 25, falls in a range of 90° C. to 120° C. Although a placement position of the temperature detecting portion 52 is slightly away from a position where the intermediate transfer belt 21 moves away from the supporting roller 25, it is possible to easily control the temperature by previously measuring a decrease of the temperature of the intermediate transfer belt 21 between both of the positions, and then compensating a value detected by the temperature detecting portion 52.

The fixing fluid applying section 51 includes a fixing fluid reservoir 53, an applying roller 54, a regulating roller 55, and a removing blade 56. The fixing fluid reservoir 53 is a container-shaped member having an internal space, and stores the fixing fluid 32 in the internal space. An opening is formed on a side face of fixing fluid reservoir 53 that faces the intermediate transfer belt 21. The applying roller 54 is a roller-shaped member that is brought into pressure-contact with the intermediate transfer belt 21 in the opening of fixing fluid reservoir 53 facing the intermediate transfer belt 21. The applying roller 54 is partly immersed in the fixing fluid 32 stored in the fixing reservoir 53, and is disposed so as to be capable of rotating in a direction of arrow 54*a* by a driving mechanism (not illustrated). As the applying roller 54, there is used a roller including a metal core, an elastic layer formed on the surface of the metal core, and a hydrophilic layer formed on the surface of the elastic layer. As the elastic layer, for example, silicone rubber, fluororubber and urethane rubber are used. As the hydrophilic layer, there is used, for example, PTFE which has been treated to be hydrophilic. The applying roller 54 can be formed so that at least a surface layer thereof includes a material having good wettability with the fixing fluid 32 described later. Although there is no particular limitation, the material is, for example, metal such as aluminum, a hydrophilic resin, and a hydrophilic rubber material. By forming such a hydrophilic surface layer, the fixing fluid 32 can be maintained as a thin layer, and a large area can by coated with even a small amount of fixing fluid 32. Accordingly, it is possible to reduce the amount of the consumed fixing fluid 32, and prevent extra fixing fluid 32 from sweeping away unfixed toner which may deteriorate a resultant image. In the present embodiment, a roller obtained as follows is used as the applying roller 54: a 12 mm-diameter metal core is provided with an elastic layer made of elastic silicone rubber, thus forming a roller of which outer diameter is 20 mm, and a surface of the elastic layer is coated with a 10 μm-thick hydrophilic layer made of PTFE which has been treated to be hydrophilic. Moreover, in the present embodiment, the applying roller 54 is brought into pressure-contact with the intermediate transfer belt 21 at a pressure of 0.5 N/cm. The applying roller 54 rotates at a speed 2% slower than the rotation speed of the intermediate transfer belt 21.

The regulating roller 55 is a roller-shaped member that is, in the opening of fixing fluid reservoir 53 facing the intermediate transfer belt 21, brought into pressure-contact with the surface of the applying roller 54 and disposed so as to be capable of rotating in a direction of arrow 55*a* by a driving mechanism (not illustrated), and regulates the fixing fluid 32 adhered to the surface of the applying roller 54 to a proper amount. The applying roller 54 and the regulating roller 55 are driven by, for example, a single gear train, and rotate at a constant speed ratio. As the regulating roller 55, for example, a metal-made roller is used. In the present embodiment, the regulating roller is a roller made of stainless steel having an outer diameter of 12 mm. Moreover, in the present embodiment, the regulating roller 55 rotates at a circumferential velocity that is half a circumferential velocity of the applying roller 54, in a direction in which the surface thereof moves in the reverse direction to the surface of the applying roller 54 in the pressure-contact area between the rollers, that is, in the direction of arrow 55*a*. The removing blade 56 is a plate-shaped member that is supported by the fixing fluid reservoir 53 at one end and brought into pressure-contact with the surface of the regulating roller 55 at the other end, and that removes the fixing fluid 32 from the surface of the regulating roller 55. As the removing blade 56, a 40 μm-thick plate made of stainless steel is used.

In the fixing fluid applying section 51, firstly, the applying roller 54 rotates in the fixing fluid 32 in the fixing fluid reservoir 53, whereby the fixing fluid 32 is adhered to the surface of the applying roller 54. The fixing fluid 32 is regulated by the regulating roller 55 so as to form a thin layer of almost even thickness. The fixing fluid layer shifts onto the toner image bearing face 21*a* of the intermediate transfer belt 21, in the pressure-contact area between the applying roller 54 and the intermediate transfer belt 21. At this moment, about half an amount of the fixing fluid 32 on the applying roller 54 is shifted to the surface of the toner image bearing face 21*a*. A toner image on the intermediate transfer belt 21 is heated as described later, thereby being brought into a state that toner-to-toner binding force of the toner 16 is increased. Therefore, when the fixing fluid 32 is applied to the toner image in contact therewith, the toner 16 of the toner image is not adhered to the applying roller 54. The toner 16 of the toner image is swelled and/or softened by the applied fixing fluid 32, and the toner image is conveyed to the transferring and fixing nip area while maintaining the swelled and/or softened condition, and transferred and fixed onto the recording medium 8.

Further, a moving section 45 and a movement control section may be provided. The moving section 45 supports the fixing fluid applying section 51 so as to be movable along the intermediate transfer belt 21. A configuration of the movement control section is the same as that of the movement control section in the image forming apparatus 1. Moreover, there may be disposed a fixing fluid application amount control section that controls the amount of the fixing fluid applied to a toner image by the fixing fluid applying section 51. The control unit 90 serves as the fixing fluid application amount control section. The fixing fluid application amount control section can be embodied with the same configuration as that of the fixing fluid application amount control section of the image forming apparatus 1 except that, instead of the rotation speed of the air flow control member 38, the rotation speed of the applying roller 54 is controlled. Since the amount of the fixing fluid borne on the surface of the applying roller 54 is almost constant at all times, it is possible to control the amount of the fixing fluid applied to a toner image, by changing the rotation speed of the applying roller 54 for every toner image. It is possible to control the rotation speed of the applying roller 54 in the same manner as control the rotation speed of the air flow control member 38 in the fixing fluid applying section 4. Further, it is also possible to control the fixing fluid application amount, by properly changing an abutting pressure of the applying roller 54 against the intermediate transfer belt 21, other than the rotation speed of the applying roller 54. The abutting pressure is regulated by using the moving section 45 that supports the fixing fluid applying section 51 so as to be movable along the intermediate transfer belt 21.

In the image forming apparatus 50, the heating section 31 disposed inside the supporting roller 25 functions as a toner binding force increasing section. The heating section 31 is placed upstream of the fixing fluid applying section 51 in the direction that the intermediate transfer belt 21 rotates (the direction of arrow 29). The fixing fluid applying section 51 has a configuration of contacting and thus applying the fixing fluid 32 to a toner image on the intermediate transfer belt 21. Therefore, when the toner-to-toner binding force of the toner 16 of the toner image is low, there is a possibility that the toner 16 is adhered to the applying roller 54 of the fixing fluid applying section 51 and the toner image is disturbed. Accordingly, by placing the heating section 31 upstream of the fixing fluid applying section 51 and preheating the toner image, the toner-to-toner binding force of the toner 16 is increased, whereby it is possible to prevent the toner image from being disturbed when the applying roller 54 contacts the toner image.

Figure 7:
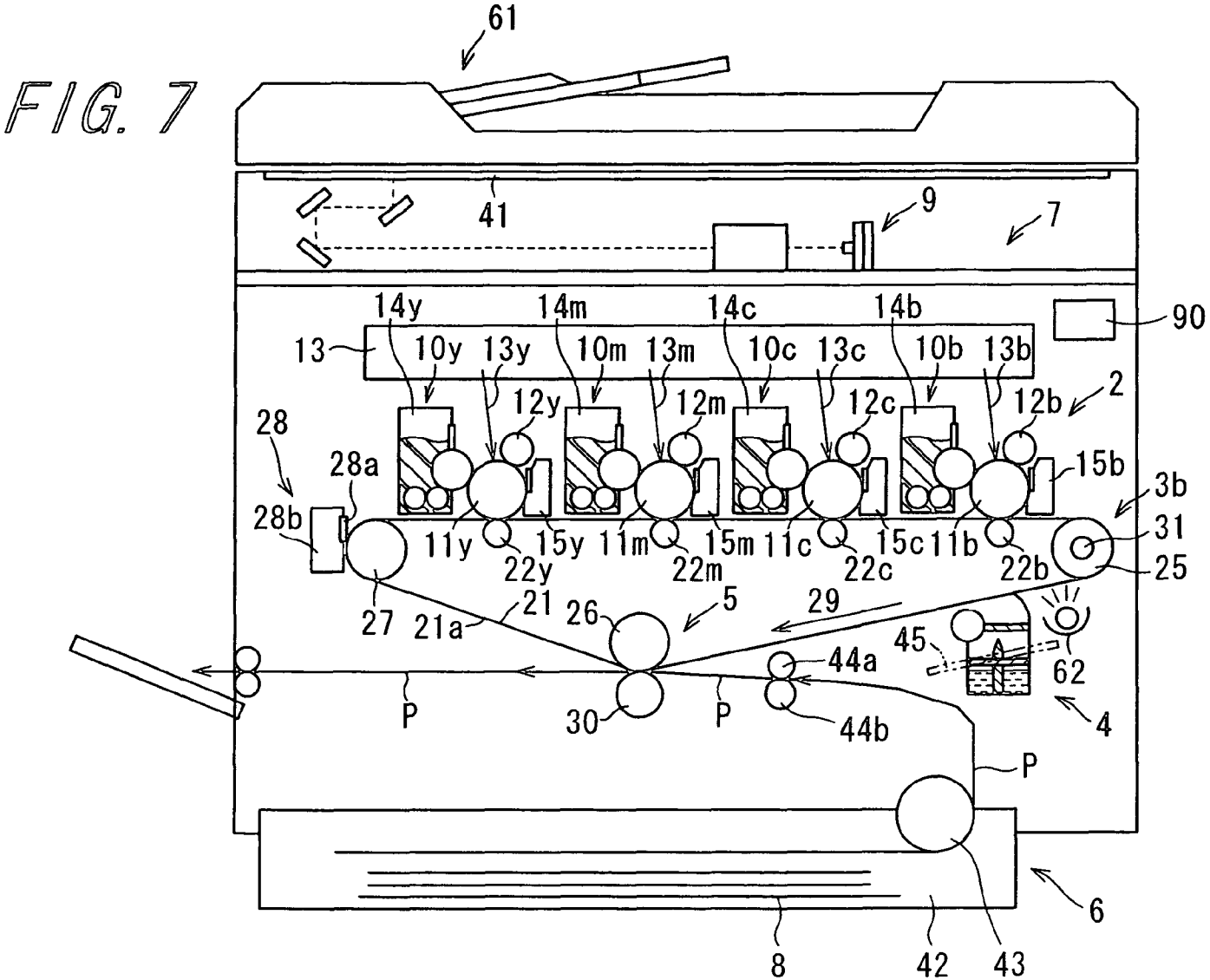
FIG. 7 is a sectional view schematically showing the constitution of an image forming apparatus according to a third embodiment.

FIG. 7 is a sectional view schematically showing the constitution of an image forming apparatus 61 according to a third embodiment. Since the image forming apparatus 61 is similar to the image forming apparatus 1, corresponding portions will be denoted by the same reference numerals, and descriptions thereof will be omitted. The image forming apparatus 61 comprises an intermediate transfer section 3*b* instead of the intermediate transfer section 3 in the image forming apparatus 1, and other components thereof are the same as those of the image forming apparatus 1. The intermediate transfer section 3*b* includes a second heating section 62 as well as the intermediate transfer belt 21, the intermediate transfer rollers 22*y*, 22*m*, 22*c* and 22*b*, the supporting rollers 25, 26 and 27, and the belt cleaner 28. The second heating section 62 is placed between the supporting roller 25 and the fixing fluid applying section 4 in the direction that the intermediate transfer belt 21 rotates, so as to face the toner image bearing face 21*a* of the intermediate transfer belt 21. The second heating section 62 heats a toner image on the intermediate transfer belt 21. Consequently, the toner 16 of the toner image can be prevented from flowing and aggregating when the fixing fluid applying section 4 applies the fixing fluid 32 to the toner image, with the result that the toner image is further free from deterioration caused by such toner flow and aggregation. As the second heating section 62, for example, a halogen lamp is used.

Figure 8:
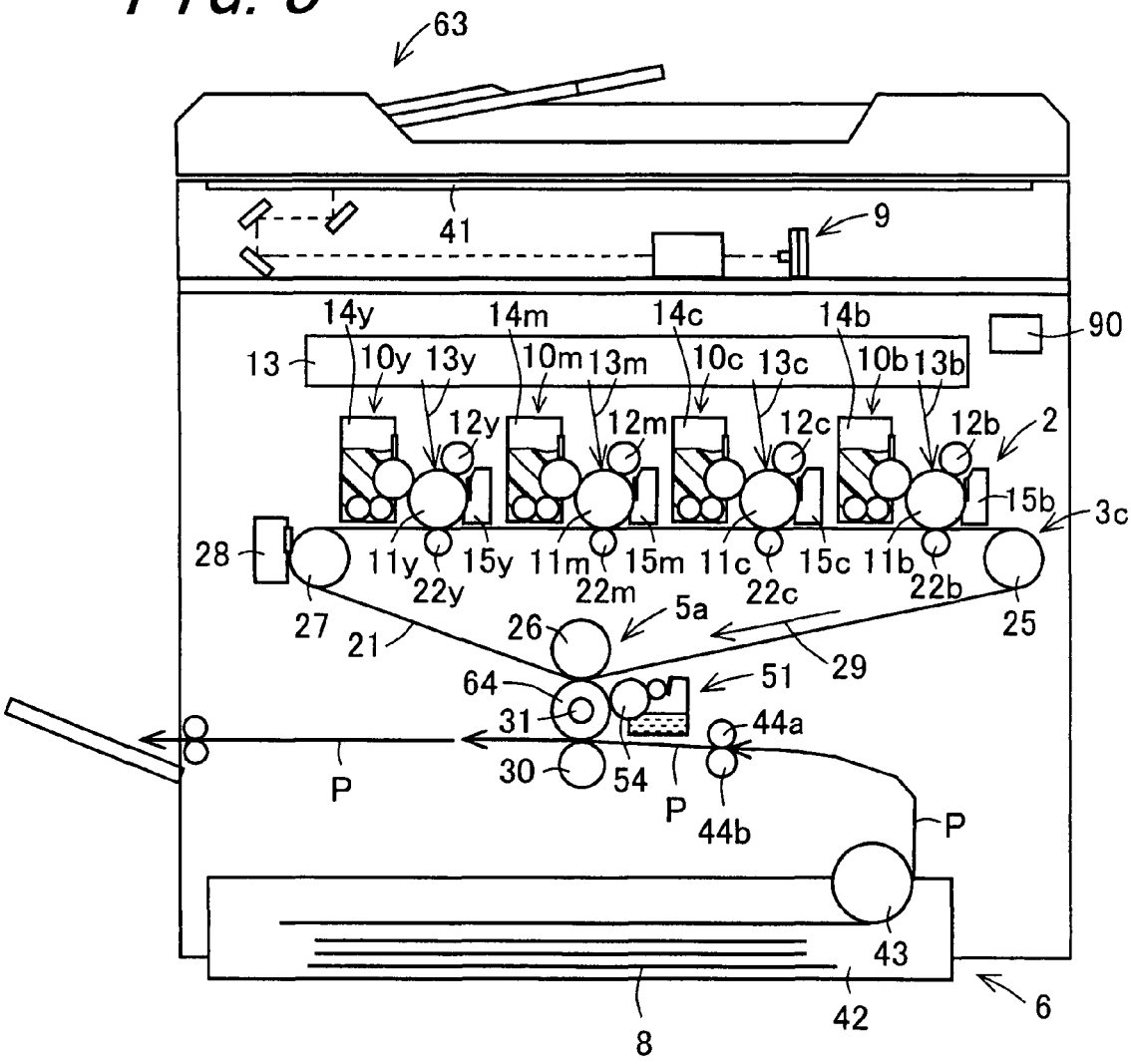
FIG. 8 is a sectional view schematically showing the constitution of an image forming apparatus according to a fourth embodiment.

FIG. 8 is a sectional view schematically showing the constitution of an image forming apparatus 63 according to a fourth embodiment. Since the image forming apparatus 63 is similar to the image forming apparatus 50, corresponding portions will be denoted by the same reference numerals, and descriptions thereof will be omitted. The image forming apparatus 63 comprises an intermediate transfer section 3*c* and a transferring and fixing section 5*a* instead of the intermediate transfer section 3*a* and the transferring and fixing section 5 in the image forming apparatus 50, and a fixing fluid and other components thereof are the same as those of the image forming apparatus 50. The intermediate transfer section 3*c* has the same configuration as the intermediate transfer section 3*a* except that the heating section is not placed inside the supporting roller 25 and the temperature detecting portion 52 of the intermediate transfer section 3*a* is not placed. The transferring and fixing section 5*a* includes the supporting roller 26, an intermediate transfer roller 64, and the transferring and fixing roller 30. The intermediate transfer roller 64 is a roller-shaped member that is brought into pressure-contact with the supporting roller 26 via the intermediate transfer belt 21 on one side, that is brought into pressure-contact with the transferring and fixing roller 30 on the other side, and that is disposed so as to be capable of rotating around an axis thereof by a driving mechanism (not illustrated). Inside the intermediate transfer roller, the heating section 31 is placed. Moreover, the fixing fluid applying section 51 is disposed so that the applying roller 54 is brought into pressure-contact with the surface of the intermediate transfer roller 64. In the transferring and fixing section 5*a*, a toner image on the toner image bearing face 21*a* of the intermediate transfer belt 21 and conveyed to a pressure-contact area between the supporting roller 26 and the intermediate transfer roller 64 is transferred to the surface of the intermediate transfer roller 64 by pressurization or by pressurization and application of voltage; toner-to-toner binding force of the toner 16 is increased by heating by the heating section 31; in this state, the toner 16 is softened and/or swelled by contact application of the fixing fluid 32 by the fixing fluid applying section 51; and the toner image is transferred and fixed to the recording medium 8 in the pressure contact area between the intermediate transfer roller 64 and the transferring and fixing roller 30.

Figure 9:
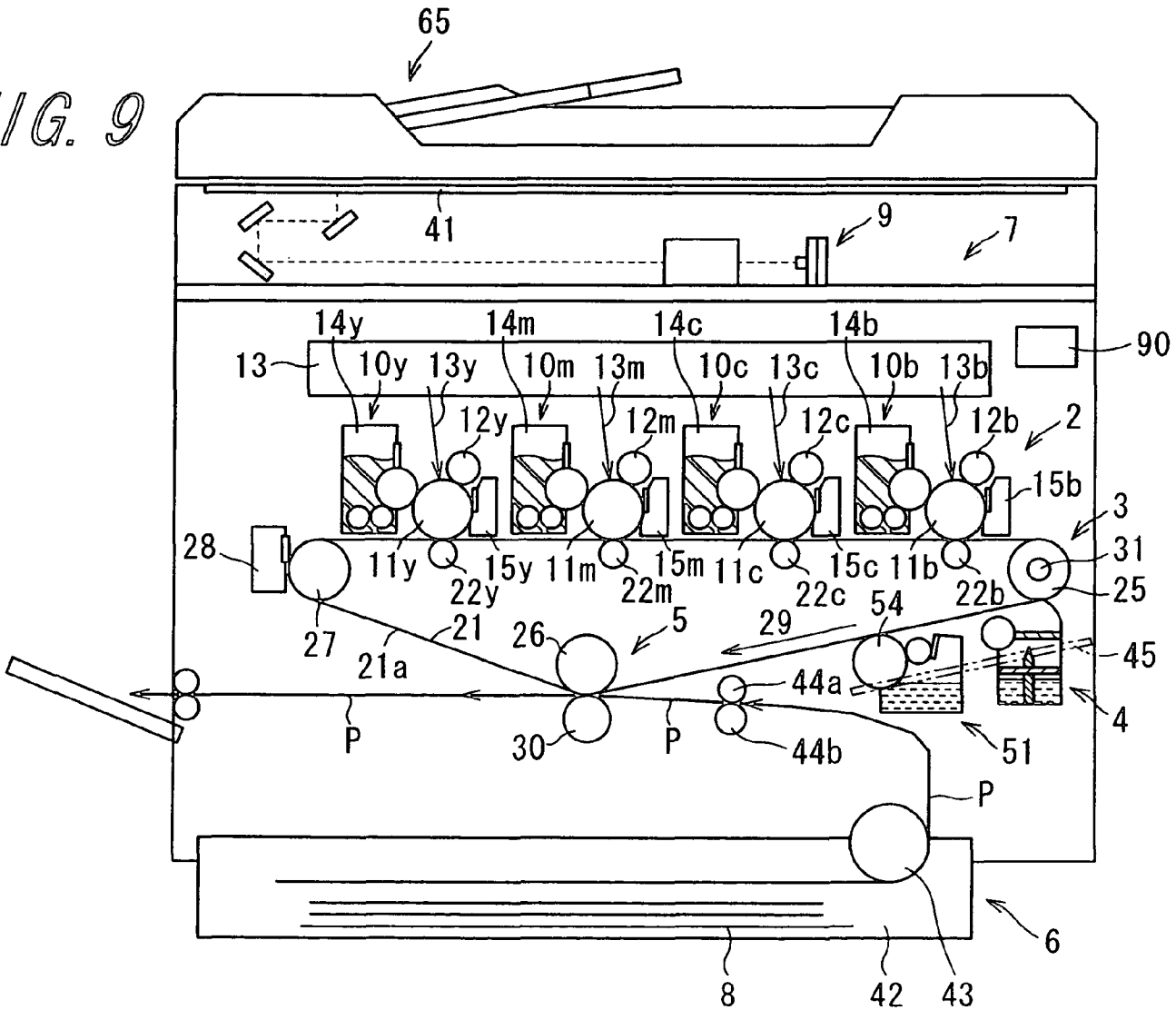
FIG. 9 is a sectional view schematically showing the constitution of an image forming apparatus according to a fifth embodiment.

FIG. 9 is a sectional view schematically showing the constitution of an image forming apparatus 65 according to a fifth embodiment. Since the image forming apparatus 65 is similar to the image forming apparatus 1, corresponding portions will be denoted by the same reference numerals, and descriptions thereof will be omitted. The image forming apparatus 65 further comprises the fixing fluid applying section 51 in the configuration of the image forming apparatus 1. The fixing fluid applying section 51 is placed downstream of the fixing fluid applying section 4 and upstream of the transferring and fixing nip area in the rotation direction of the intermediate transfer belt 21 (the direction of arrow 29) so that the applying roller 54 is brought into pressure-contact with the toner image bearing face 21*a* of the intermediate transfer belt 21. In the image forming apparatus 65, a toner image on the intermediate transfer belt 21 is preheated by the heating section 31 embedded in the supporting roller 25, and then receives application of the fixing fluid 32 without contacting the toner image by the fixing fluid applying section 4; in a state where the toner 16 contained in the toner image starts softening and/or swelling and toner-to-toner binding force of the toner 16 is increased, the toner image receives application of the fixing fluid 32 in contact therewith by the fixing fluid applying section 51, and the toner 16 is softened and/or swelled sufficiently; and in this state, the toner image is conveyed to the transferring and fixing nip area where the toner image is then transferred and fixed to the recording medium 8. Preheating by the heating section 31 is executed for prevention of flow and aggregation of the toner 16 when the fixing fluid 32 is applied by the fixing fluid applying section 4. Application of the fixing fluid 32 by the fixing fluid applying section 4 is executed mainly to increase the toner-to-toner binding force of the toner 16, and prevent the toner from being adhered to the applying roller 54 at the time of application of the fixing fluid 32 by the fixing fluid applying section 51 so that a toner image is free from being disturbed. Therefore, the amount of the fixing fluid 32 applied by the fixing fluid applying section 4 can be smaller than the application amount in the image forming apparatus 1. Application of the fixing fluid 32 by the fixing fluid applying section 51 is executed mainly to soften and/or swell the toner 16 forming a toner image to an appropriate degree for transferring and fixing.

In the present specification, the adhesive force A (the adhesive force between the intermediate transfer belt 21 and the toner) and the adhesive force B (the adhesive force between the recording medium 8 and the toner) were each obtained as adhesive force by the 180-degree peel test (measurement conditions: 23±2° C., 50±5% RH) with respect to a test plate (25 mm wide), in conformity with the "testing methods of pressure-sensitive adhesive tapes and sheets" of JIS 20237. Here, the test plate is the intermediate transfer belt 21 and the recording medium 8. A specific measurement method will be described with reference to the drawings.

(Experiment 1)

[Measurement of the Adhesive Force A]

Figure 10:
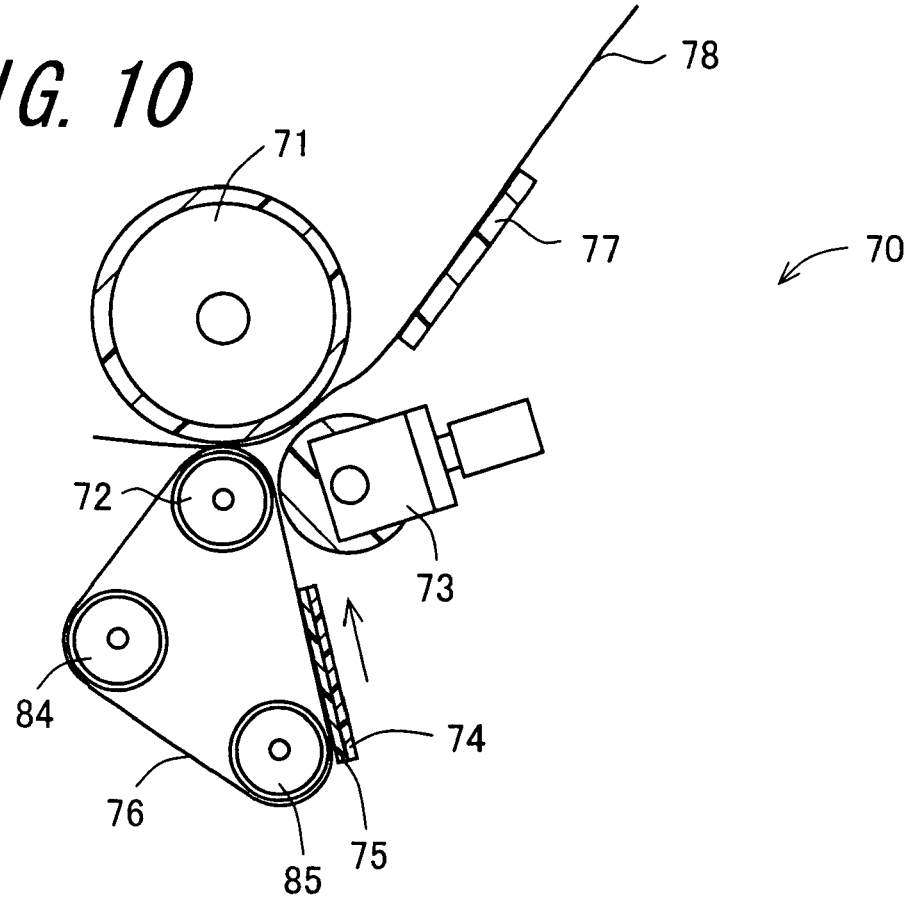
FIG. 10 is a partial sectional view schematically showing the constitution of an adhesion measuring apparatus for measuring adhesive force A.

The adhesive force A was measured by using an adhesion measuring apparatus 70 illustrated in FIG. 10. FIG. 10 is a partial sectional view schematically showing the constitution of the adhesion measuring apparatus 70 for measuring the adhesive force A. The adhesion measuring apparatus 70 comprises pressure-contact rollers 71 and 72, a fixing fluid contact applying section 73, a conveying belt 76, supporting rollers 84 and 85, and a first recording medium placement section (not illustrated). The pressure-contact roller 71 is disposed so as to be capable of rotating by a driving mechanism (not illustrated), and rotates at a process speed of 117 mm/sec. The pressure-contact roller 72 is brought into pressure-contact with the pressure-contact roller 71 at a surface pressure of approximately 29.42 Pa (3 kg/cm$^2$) so as to form a pressing nip area together with the pressure-contact roller 71, and makes driven rotation by driving rotation of the pressure-contact roller 71. The fixing fluid contact applying section 73 is a sponge roller impregnated with the fixing fluid 32. The amount of the fixing fluid applied to a toner image was set to 0.3 mg/cm$^2$. This is an application amount for fixing a three-layered toner image.

A semi-conductive belt piece 75 (composed of the same material as the intermediate transfer belt 21 of the image forming apparatus, 50 mm in width, and 150 mm in length), on a surface of which a toner image 74 was formed, was stuck to the conveying belt 76, and conveyed to the pressing nip area. During conveyance, the fixing fluid 32 was applied to the toner image 74 borne on the conveying belt 76 by the fixing fluid contact applying section 73. The toner image 74 was a solid toner image having a width of 25 mm and a length of 150 mm. Two kinds of images were prepared: a single-layered toner image of cyan (the adhesion amount of the toner was 0.35 mg/cm$^2$); and a three-layered toner image of cyan, magenta and yellow (the adhesion amount of the toner was 1.05 mg/cm$^2$). The toner image 74 was formed onto the semi-conductive belt piece 75 by sticking the semi-conductive belt piece 75 to the toner image bearing face 21*a* of the intermediate transfer belt 21 in the image forming apparatus 50 illustrated in FIG. 5. After the semi-conductive belt piece 75 with the toner image 74 formed on the surface passed by the surface of the supporting roller 25 including the heating section 31, the semi-conductive belt piece was taken out of the image forming apparatus 50 before coming in contact with the applying roller 54 of the fixing fluid applying section 51. Then, the semi-conductive belt piece was stuck to the conveying belt 76.

On the first recording medium placement section, a recording medium 78 to which an adhesive tape 77 (25 mm in width and 125 mm in length with adhesive force of 20 N/25 mm) was stuck was placed. As the recording medium 78, a sheet of paper having a weight per unit area of 64 g/m$^2$ was used. A position at which the semi-conductive belt piece 75 was stuck to the conveying belt 76 and a position at which the adhesive tape 77 was stuck to the recording medium 78 were determined so that the semi-conductive belt piece 75 and the adhesive tape 77 were at the same position when the conveying belt 76 and the recording medium 78 were overlaid and pressurized at the pressing nip area. The recording medium 78 was pulled by rotation of the pressure-contact rollers 71 and 72 and thus conveyed to the pressing nip area.

Figure 11:
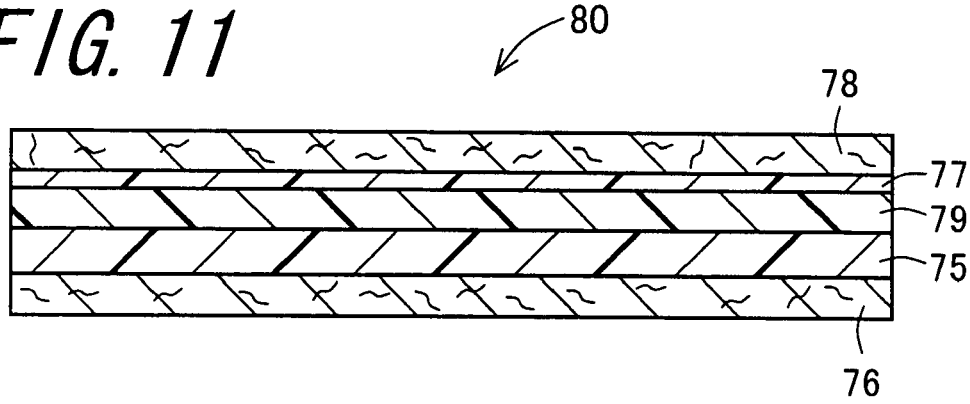
FIG. 11 is a sectional view schematically showing the constitution of a sample for measuring the adhesive force A.
Figure 12:
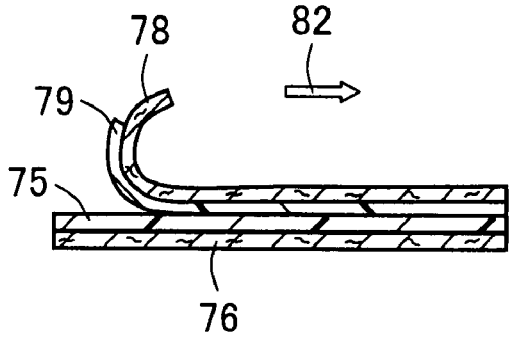
FIG. 12 is a sectional view showing the outline of a 180-degree peel test defined in JIS Z-0237.
Figure 15:
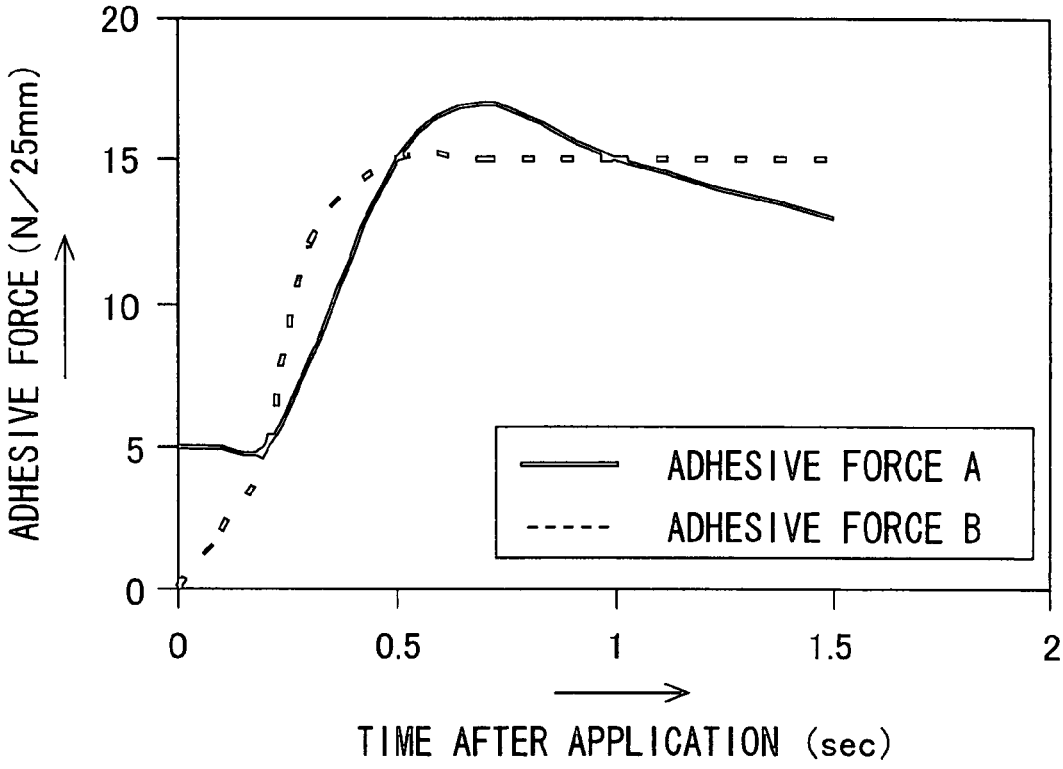
FIG. 15 is a graph showing a relation between a time after application of a fixing fluid to a toner image and adhesive force.

With the adhesion measuring apparatus 70 having the above configuration, a measurement sample 80 was obtained by overlaying and pressing the semi-conductive belt piece 75 and the recording medium 78 at the pressing nip area and, as illustrated in FIG. 11, sticking the adhesive tape 77 to a toner layer 79 composed of the toner 16 swelled and/or softened by application of the fixing fluid 32. After the measurement sample passed through the pressing nip, the conveying belt 76 was stopped, and a free end of the recording medium 78 was folded 180 degrees after a predetermined time (0.1, 0.2, 0.3, 0.5, 0.7, 1.0, 1.5 seconds) after application of the fixing fluid 32, and peeled at a process speed of 117 mm/sec. At that time, a load required to peel the recording medium 78 to which the toner layer 79 had been stuck from the semi-conductive belt 75 was measured. FIG. 11 is a sectional view schematically showing the constitution of the sample for measuring the adhesive force A. FIG. 12 is a sectional view showing the outline of the 180-degree peel test defined in JIS Z-0237. The same operation was repeated three times, and an average value of three measurement results was determined as the adhesive force A between the intermediate transfer belt and the toner layer. The result regarding the single-layered toner image of cyan is illustrated in FIG. 15. The result regarding the three-layered toner image of cyan, magenta and yellow is illustrated in FIG. 16.

[Measurement of the Adhesive Force B]

Figure 13:
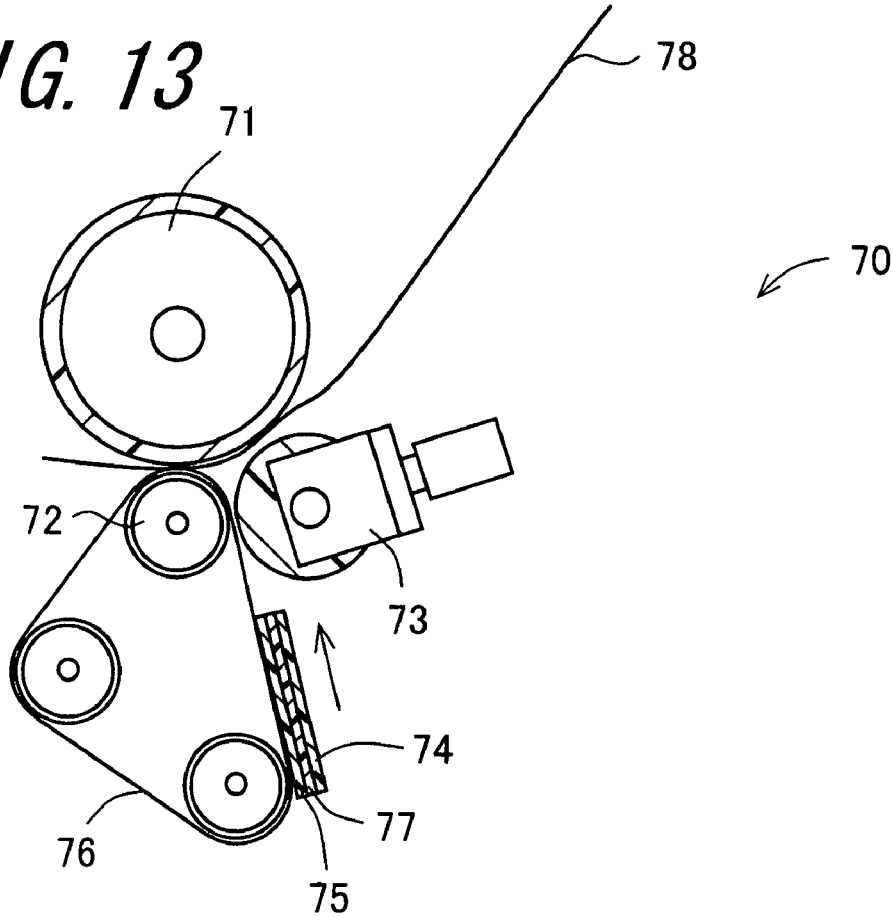
FIG. 13 is a partial sectional view schematically showing the constitution of an adhesion measuring apparatus for measuring adhesive force B.
Figure 14:
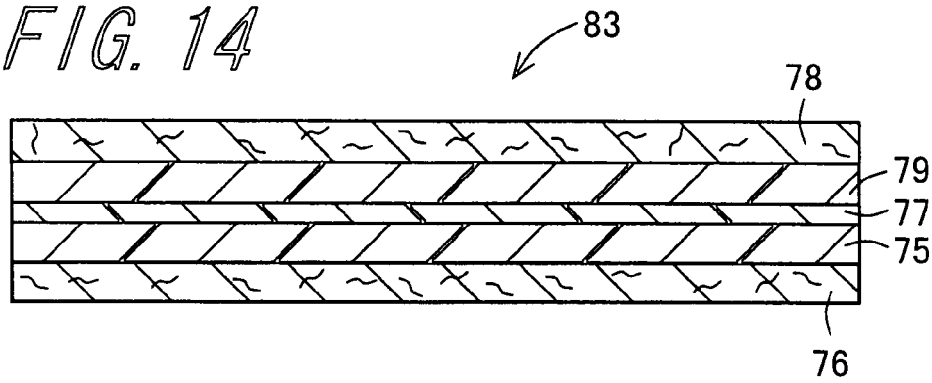
FIG. 14 is a sectional view schematically showing the constitution of a sample for measuring the adhesive force B.

FIG. 13 is a partial sectional view schematically showing the constitution of the adhesion measuring apparatus 70 for measuring the adhesive force B. FIG. 14 is a sectional view schematically showing the constitution of a sample 83 for measuring the adhesive force B. As illustrated in FIG. 13, with the adhesion measuring apparatus 70, the measurement sample 83 illustrated in FIG. 14 was produced in the same manner as the sample for measuring the adhesive force A, except that the adhesive tape 77 was stuck onto the semi-conductive belt piece 75, the toner image 74 was formed on the surface of the adhesive tape 77, and the adhesive tape 77 was not stuck to the surface of the recording medium 78. The measurement sample 83 is a lamination in which the conveying belt 76, the semi-conductive belt piece 75, the adhesive tape 77, the toner layer 79 swelled and/or softened by application of the fixing fluid 32, and the recording medium 78 are laminated in this order. A free end of the recording medium 78 was folded 180 degrees after a predetermined time (0.1, 0.2, 0.3, 0.5, 0.7, 1.0, 1.5 seconds) after application of the fixing fluid 32, and peeled at a process speed of 117 mm/sec. At that time, a load required to peel the recording medium 78 from the toner layer 79 was measured. The same operation was repeated three times, and an average value of three measurement results was determined as the adhesive force B between the recording medium and the toner layer. The result regarding the single-layered toner image of cyan is illustrated in FIG. 15. The result regarding the three-layered toner image of cyan, magenta and yellow is illustrated in FIG. 16. FIGS. 15 and 16 are graphs each showing a relation between a time after application of the fixing fluid to the toner image and the adhesive force (the adhesive force A and the adhesive force B).

Figure 16:
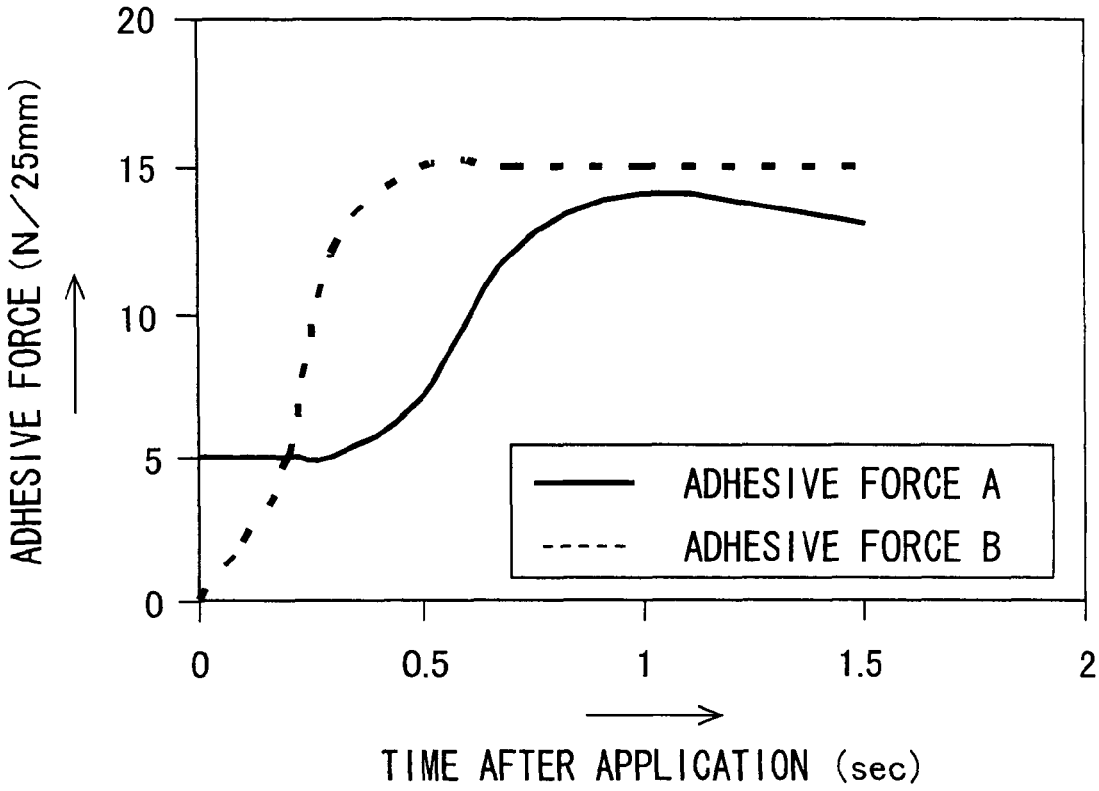
FIG. 16 is a graph showing a relation between a time after application of a fixing fluid to a toner image and adhesive force.

From FIGS. 15 and 16, it is found that, in a case where a single-layered toner image (here, the single-layered toner image of cyan) was formed in the configuration of the image forming apparatus 50, the condition of adhesive force B>adhesive force A was obtained from a point of 0.2 second to a point of 0.5 second after application of the fixing fluid 32, and after 1.0 second after the application. In a case where a three-layered toner image (here, the three-layered toner image of cyan, magenta and yellow) was formed, the condition of adhesive force B>adhesive force A was obtained after 0.2 second and more after the application of the fixing fluid 32. The value of the adhesive force B in the above time periods was 5 to 15 (N/25 mm). In order to convey a toner image in the swelled and/or softened state to the transferring and fixing nip area to transfer and fix to the recording medium 8 when the condition of adhesive force B>adhesive force A was achieved as described above, a position at which the fixing fluid is applied to the toner image by the fixing fluid applying section 4 should be properly selected according to a process speed due to driving rotation of the intermediate transfer belt 21.

(Experiment 2)

Figure 17:
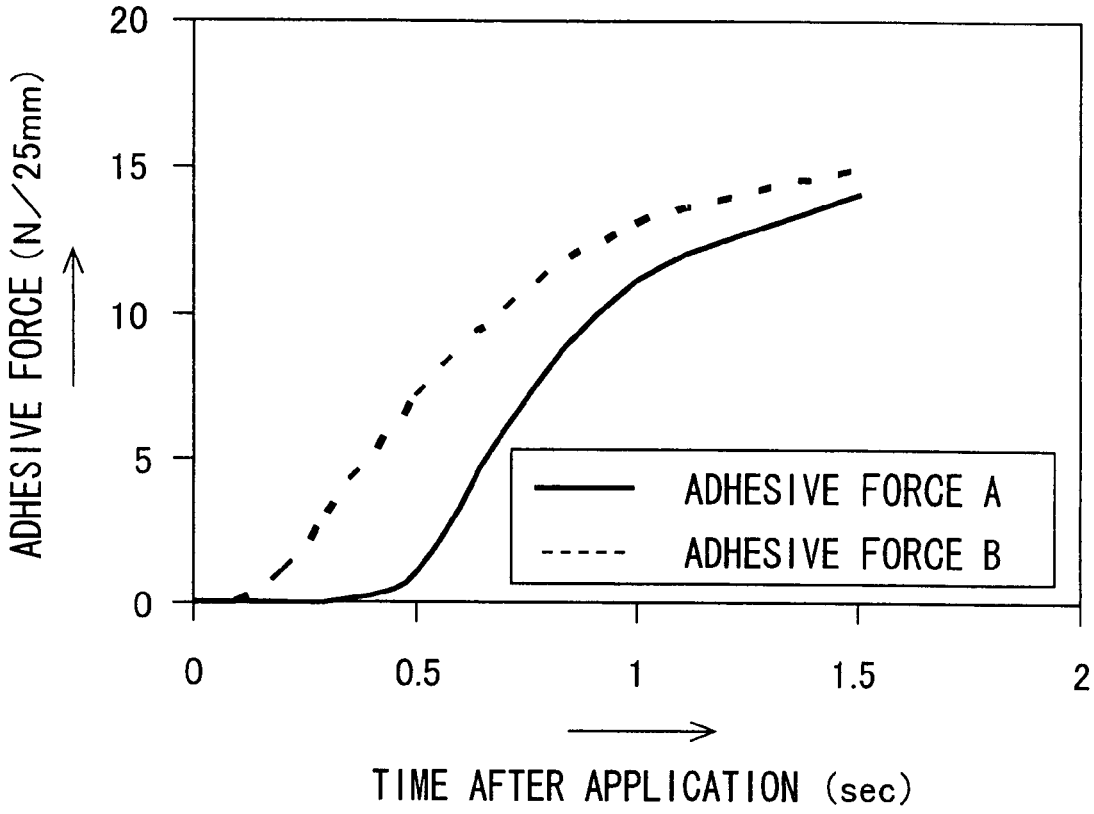
FIG. 17 is a graph showing a relation between a time after application of a fixing fluid to a toner image and adhesive force.

In the same manner as in the experiment 1 except that a toner image was formed by using the image forming apparatus 1 illustrated in FIG. 1, a fixing fluid application amount was set to 1.2 mg/cm$^2$ and a recording medium having a weight per unit area of 52 g/m$^2$ was used, the adhesive force A and the adhesive force B of the three-layered toner image were measured. The result regarding the three-layered toner image is illustrated in FIG. 17. FIG. 17 is a graph illustrating a relation between a time after application of the fixing fluid to the toner image and the adhesive force (the adhesive force A and the adhesive force B). In FIG. 17, the adhesive force B is more than the adhesive force A at all times. This clearly shows that the condition of adhesive force B>adhesive force A can be realized in the configuration of the image forming apparatus 1 by selecting the fixing fluid application amount and/or the kind of the recording medium 8.

(Experiment 3)

Figure 18:
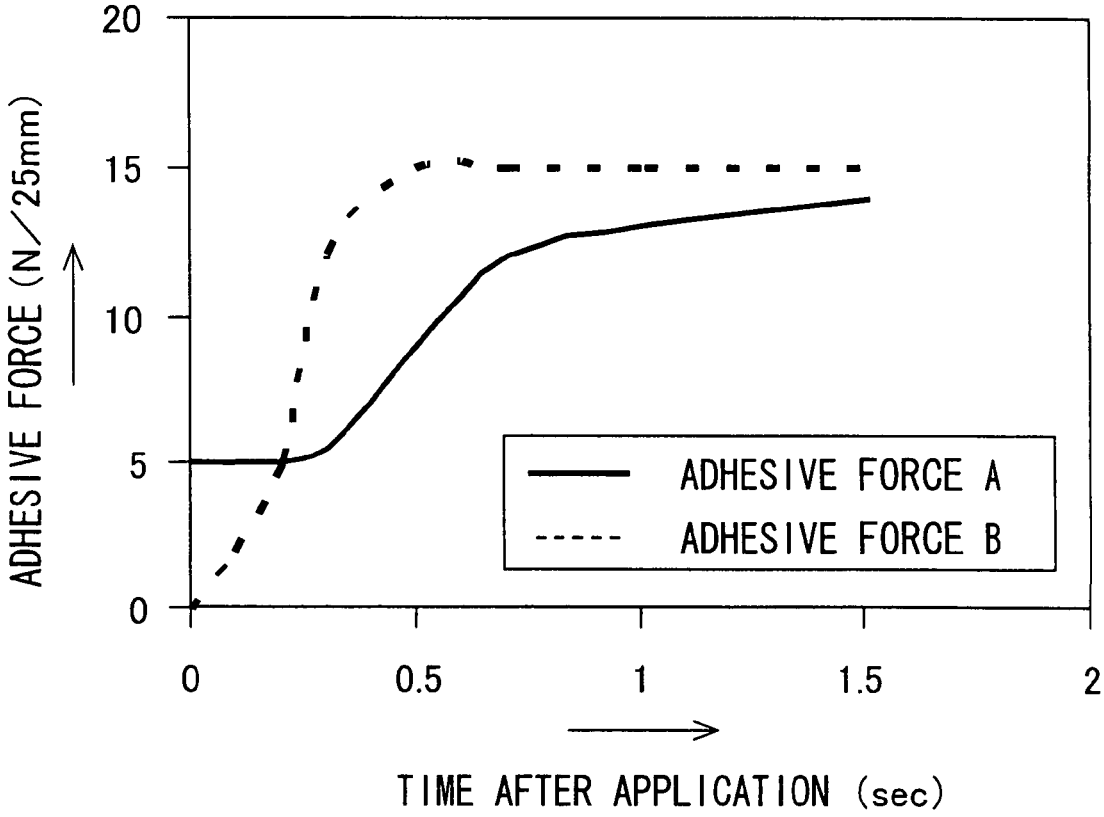
FIG. 18 is a graph showing a relation between a time after application of a fixing fluid to a toner image and adhesive force.
Figure 19:
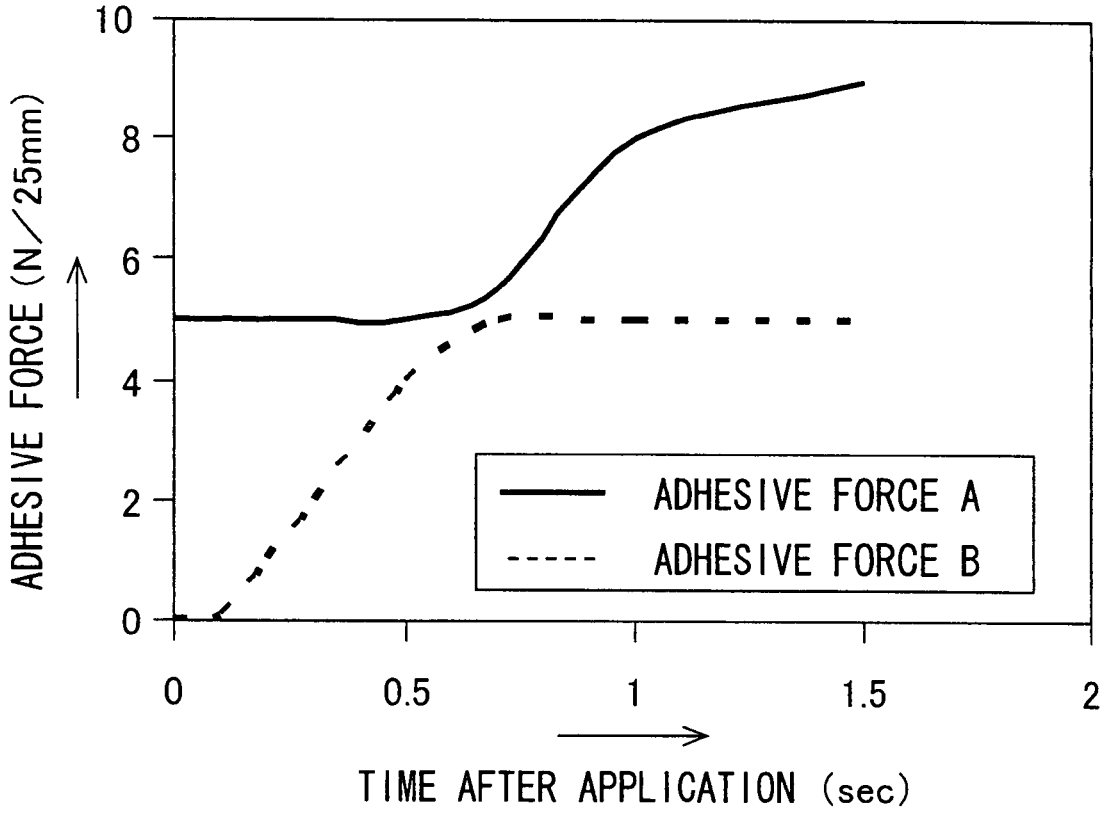
FIG. 19 is a graph showing a relation between a time after application of a fixing fluid to a toner image and adhesive force.
Figure 20:
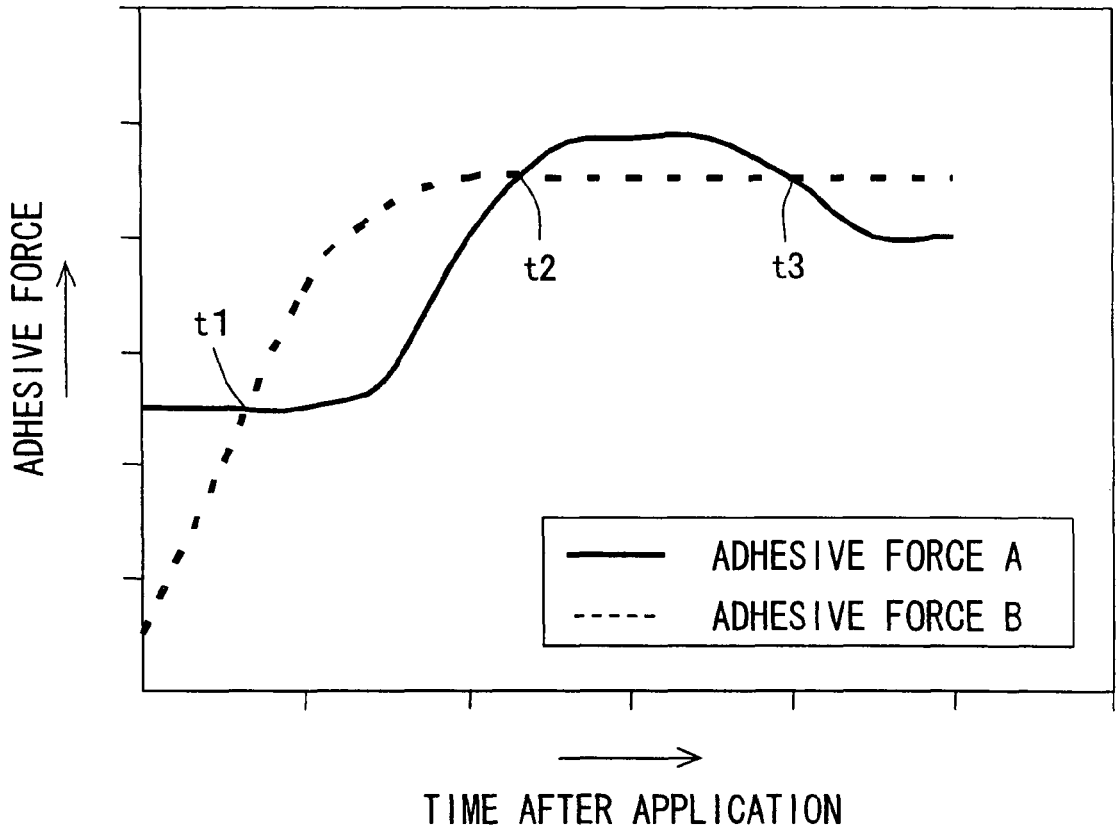
FIG. 20 is a graph showing a relation between a time after application of a fixing fluid to a toner image and adhesive force.
Figure 21:
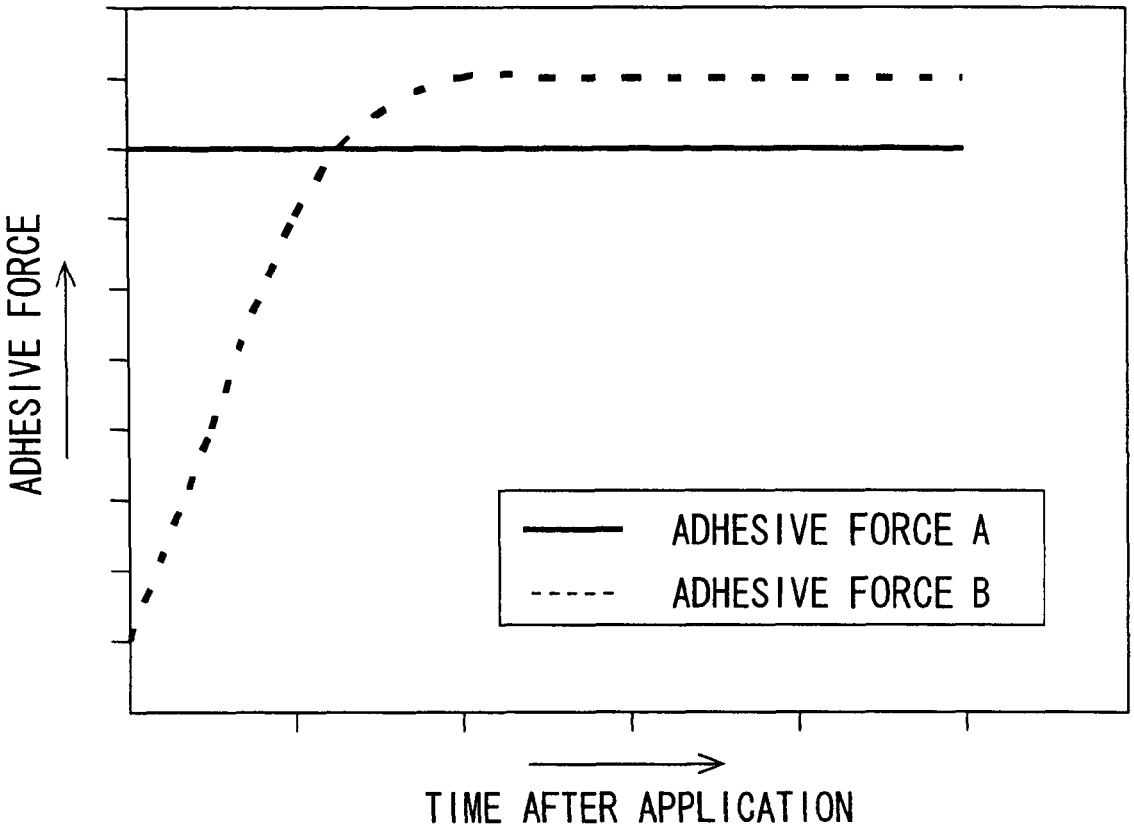
FIG. 21 is a graph showing a relation between a time after application of a fixing fluid to a toner image and adhesive force.
Figure 22:
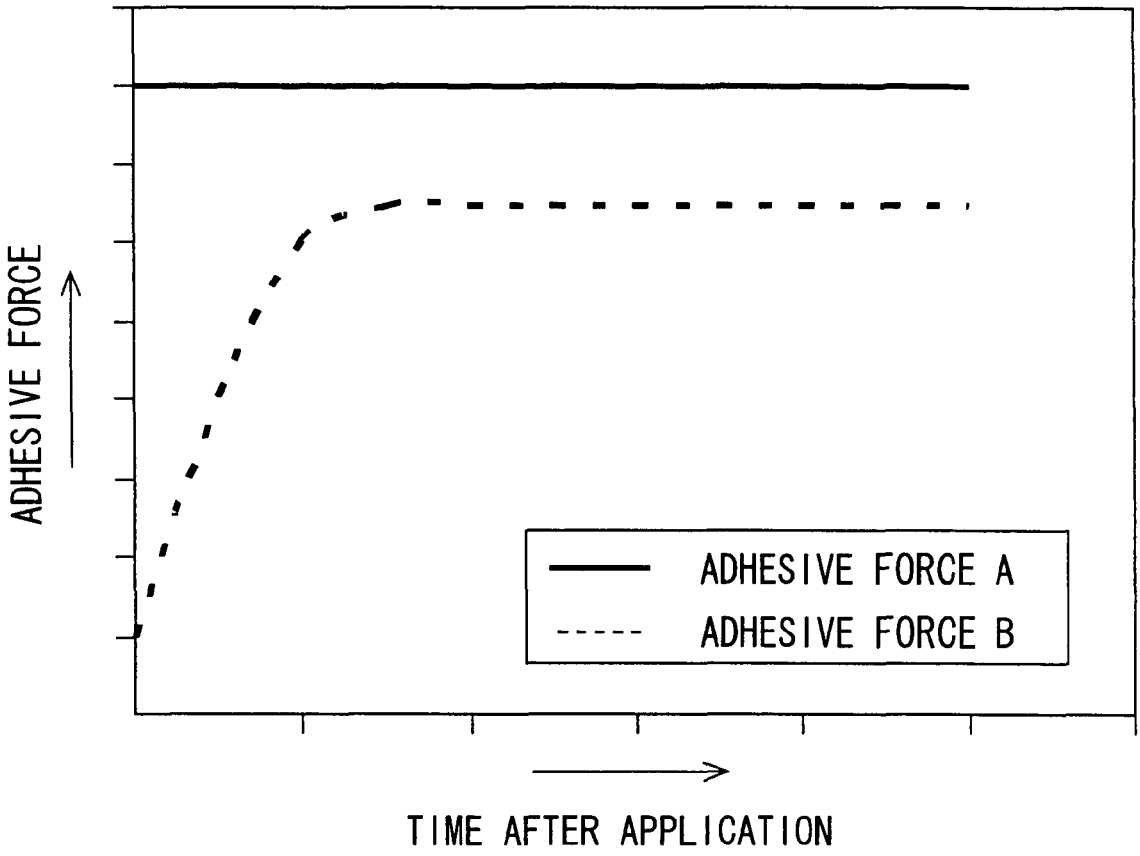
FIG. 22 is a graph showing a relation between a time after application of a fixing fluid to a toner image and adhesive force.

In the same manner as in the experiment 1 except that a fixing fluid application amount was set to 0.16 mg/cm$^2$, the adhesive force A and the adhesive force B in each of the single-layered toner image and the three-layered toner image were measured. The result regarding the single-layered toner image is illustrated in FIG. 18, and the result regarding the three-layered toner image is illustrated in FIG. 19. FIGS. 18 and 19 are graphs each illustrating a relation between a time after application of the fixing fluid to the toner image and the adhesive force (the adhesive force A and the adhesive force B). The fixing fluid application amount in the experiment 3 is an optimum amount for fixing the single-layered toner image. A point where the relation of adhesive force B>adhesive force A was achieved in the case of formation of the single-layered toner image was after 0.2 second after application of the fixing fluid 32. On the other hand, in the case of formation of the three-layered toner image, the adhesive force B never became more than the adhesive force A.

From the above results, in order to achieve the condition of adhesive force B>adhesive force A at the transferring and fixing nip area in the toner image to which the fixing fluid 32 is applied by the fixing fluid applying section 4 or 51, it is necessary to change the fixing fluid application amount according to the number of the layers of the toner image. Such change can be executed by the aforementioned fixing fluid application amount control section.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. An image forming apparatus comprising:

a toner image forming section that forms a toner image;

a toner image bearing section including a toner image bearing member that rotates while bearing on a surface thereof the toner image formed by the toner image forming section;

a transfer section that transfers the toner image on the toner image bearing member onto a recording medium;

a fixing fluid applying section that applies a fixing fluid having an effect of softening toner, to the toner image on the toner image bearing member;

a moving section that supports the fixing fluid applying section so as to be movable along a movement direction of the toner image bearing member; and a movement control section that controls a position of the fixing fluid applying section along the toner image bearing member to change a position for application of the fixing fluid, thereby changing the duration of a time period that elapses between application of the fixing fluid to the toner image by the fixing fluid applying section and the transfer of the toner image onto the recording medium by the transfer section so that an adhesive force A (N/25 mm) between the toner and the toner image bearing member becomes smaller than an adhesive force B (N/25 mm) between the toner and the recording medium when the toner image with the fixing fluid is transferred from the toner image bearing member to the recording medium.

2. The image forming apparatus of claim 1, further comprising a heating section that heats the toner image on the toner image bearing member, and/or a pressing section that presses the toner image on the toner image bearing member, provided on an upstream side of the transfer section in a rotation direction of the toner image bearing member.

3. The image forming apparatus of claim 1, wherein the toner image bearing member is an endless belt-shaped member having a fluororesin containing layer on a surface thereof.

4. The image forming apparatus of claim 1, wherein the toner image bearing member is an endless belt-shaped member including an elastic layer.

5. The image forming apparatus of claim 1, further comprising a fixing fluid application amount control section that controls an amount of the fixing fluid applied to the toner image by the fixing fluid applying section.

6. An image forming apparatus comprising:

a toner image forming section that forms a toner image;

a toner image bearing section including a toner image bearing member that rotates while bearing on a surface thereof the toner image formed by the toner image forming section;

a transfer section that transfers the toner image on the toner image bearing member onto a recording medium;

a fixing fluid applying section that applies a fixing fluid having an effect of softening toner, to the toner image on the toner image bearing member; and a fixing fluid application amount control section that controls an amount of the fixing fluid applied to the toner image per unit of area by the fixing fluid applying section, wherein the fixing fluid applying section and the transfer section are placed so that an adhesive force A between the toner and the toner image bearing member becomes smaller than an adhesive force B between the toner and the recording medium when the toner image with the fixing fluid is transferred from the toner image bearing member to the recording medium.

7. The image forming apparatus of claim 6, wherein the fixing fluid amount control section varies an amount of fixing fluid that is applied to the toner image per unit of area based on the type of toner in the toner image.

8. The image forming apparatus of claim 6, wherein the fixing fluid amount control section varies an amount of fixing fluid that is applied to the toner image per unit of area based on the colors of the toner in the toner image.

9. The image forming apparatus of claim 6, wherein the fixing fluid amount control section varies an amount of fixing fluid that is applied to the toner image per unit of area based on the number of different colors of toner in the toner image.

* * * * *